US011759023B2

(12) United States Patent
Shin

(10) Patent No.: US 11,759,023 B2
(45) Date of Patent: Sep. 19, 2023

(54) THREE-DIMENSIONAL WAVE GENERATING DEVICE AND MULTIFUNCTIONAL MOTION BED HAVING THE SAME

(71) Applicant: GHL CO., LTD., Namyangju-si (KR)

(72) Inventor: Ki Young Shin, Namyangju-si (KR)

(73) Assignee: GHL CO., LTD., Namyangju-si (KR)

( * ) Notice: Subject to any disclaimer, the term of this patent is extended or adjusted under 35 U.S.C. 154(b) by 0 days.

(21) Appl. No.: 17/282,515

(22) PCT Filed: Oct. 12, 2020

(86) PCT No.: PCT/KR2020/013862
§ 371 (c)(1),
(2) Date: Apr. 2, 2021

(87) PCT Pub. No.: WO2021/075809
PCT Pub. Date: Apr. 22, 2021

(65) Prior Publication Data

US 2022/0369824 A1 Nov. 24, 2022

(30) Foreign Application Priority Data

Oct. 14, 2019 (KR) ..... 10-2019-0127188

(51) Int. Cl.
*A47C 21/00* (2006.01)

(52) U.S. Cl.
CPC ..... *A47C 21/006* (2013.01)

(58) Field of Classification Search
CPC ... A47C 21/006; A47C 20/048; A47C 27/081; A61H 9/0078; A61H 23/0254;
(Continued)

(56) References Cited

U.S. PATENT DOCUMENTS 4,527,298 A * 7/1985 Moulton ..... A61G 7/002 5/660
5,275,577 A * 1/1994 Hildebrandt ..... H02K 7/1004 474/166
2015/0282630 A1* 10/2015 Mcintyre ..... A47C 20/048 5/660

FOREIGN PATENT DOCUMENTS

JP 11247871 9/1999
JP 2002130400 5/2002
(Continued)

OTHER PUBLICATIONS

English Translation of KR 10-2006-0095661 (Year: 2005).*
(Continued)

*Primary Examiner* — Myles A Throop
(74) *Attorney, Agent, or Firm* — CANTOR COLBURN LLP

(57) ABSTRACT

Provided is a three-dimensional wave generating device and a multifunctional motion bed having the same. A safety device prevents a driven pulley and/or a driven pulley to which an eccentric shaft is coupled from being separated from a coupling shaft. Therefore, operation stability is secured while noise caused by separation or unstable coupling of the driven pulley and/or eccentric shaft in a three-dimensional wave generating device is prevented from occurring, and when a functional motion bed to which the three-dimensional wave generating device is applied is provided, the user can feel a three-dimensional wave more effectively in bed.

24 Claims, 20 Drawing Sheets

(58) Field of Classification Search
CPC .... A61H 2201/0107; A61H 2201/0146; A61H 2201/0169; A61H 2201/1238; A61H 2201/1253; A61H 2201/14; A61H 2201/1671; A61H 2201/5007; A61H 2201/5048; A61H 2203/0443; A61H 2201/1661; A61H 23/02; A61G 7/002
USPC ..... 5/660
See application file for complete search history.

(56) References Cited

FOREIGN PATENT DOCUMENTS

| | | | |
|---|---|---|---|
| KR | 200298371 | | 12/2002 |
| KR | 200380292 | Y1 * | 3/2005 |
| KR | 100480957 | B1 * | 4/2005 |
| KR | 200423041 | | 8/2006 |
| KR | 20060095661 | A * | 9/2006 |
| KR | 100672063 | | 1/2007 |
| KR | 101485573 | | 1/2015 |
| KR | 101496089 | | 2/2015 |
| KR | 101721549 | B1 * | 3/2017 |
| KR | 20170061650 | | 6/2017 |
| KR | 101810501 | B1 * | 12/2017 |
| KR | 101946521 | | 2/2019 |
| KR | 102150048 | | 8/2020 |
| KR | 102269124 | B1 * | 6/2021 |
| WO | WO-2004107925 | A1 * | 12/2004 |

OTHER PUBLICATIONS

International Search Report—PCT/KR2020/013862 dated Jan. 20, 2021.

PCT Written Opinion—PCT/KR2020/013862 dated Jan. 20, 2021, citing KR 10-1946521, KR 10-0672063, JP 11-247871, and JP 2002-130400.

* cited by examiner (a)

(b)

(c)

(d)

THREE-DIMENSIONAL WAVE GENERATING DEVICE AND MULTIFUNCTIONAL MOTION BED HAVING THE SAME

TECHNICAL FIELD

The present invention relates to a three-dimensional wave generating device and a multifunctional motion bed having the same, and more particularly, to a three-dimensional wave generating device, in which coupling force(s) of a belt-coupled pulley and/or an eccentric shaft included therein increase(s) while a problem caused by separation of the pulley and/or eccentric shaft is reduced, and a multifunction motion bed having the same.

BACKGROUND ART

Beds have been simply recognized as a piece of furniture for sleeping. However, in recent years, various activities such as watching TV or reading a book are made in beds, and the function of beds is changing in various ways.

The most common is a bed in which an angle of a mattress is adjusted. In particular, there is a bed provided to provide a more comfortable posture to a patient who feels uncomfortable or pain in a specific site in a hospital.

There are several types of beds, such as a bed manually adjusted by a combination of a rack and a pinion or a bed automatically adjusted by a motor. In the case of a bed with a heavy load, a hydraulic cylinder is used to adjust an angle of the bed.

However, all angle adjustment devices applied to automatically adjust the angles of the beds as described above have a complex structure and generate severe noise during a deployment operation, and an after-sales service (A/S) such as part replacement is difficult when a failure occurs.

Meanwhile, there are cases where a vibration mechanism for implementing a massage function is applied to the above-described bed, and in the vibration mechanism, a vibration rotating body is eccentrically coupled to a drive shaft of a motor, or a vibration rotating body is connected to a drive pulley of the motor via a belt, and thus, the vibration rotating body can transmit vibrations to an object while rotating when the motor is driven.

That is, the vibration mechanism performs a massage or massage function by generating vibrations from a high-speed rotation and a dynamic imbalance when the vibration rotating body eccentrically coupled to the drive shaft of the motor rotates.

However, in the vibration mechanism of the related art, due to the vibrations of the vibrating rotating body eccentrically coupled to the drive shaft of the motor, the drive shaft of the motor may be cracked or broken. Accordingly, breakdowns frequently occur, a frequency of use is reduced due to noise, and there is a problem that the bed having the vibration mechanism is difficult to use in apartment houses or apartments due to noise.

Accordingly, the inventor (Ki-Young, SHIN) of the present invention has reached a solution to the above-described problems through Korean Patent No 10-1946521 (hereinafter, referred to as a "pre-registered patent") filed on May 8, 2018.

However, in the pre-registered patent, a driven pulley and/or an eccentric shaft is coupled by a bolt (for example, hexagonal bolt) or the like. Accordingly, a constant coupling force of the driven pulley cannot be maintained, and when a three-dimensional wave generating device is used for a long time, the driven pulley to which the eccentric shaft is coupled is separated from a rotating shaft portion. Therefore, the present invention is for reducing the problems of the pre-registered patent.

That is, in the pre-registered patent, as illustrated in FIGS. 1 and 2, a driven pulley C (reference numeral 65 of the pre-registered patent) having a bearing B is coupled to a rotating shaft portion A (reference numeral 61*b* of the pre-registered patent) formed in a center of a housing by a force-fitting method, and thereafter, an eccentric shaft D (reference numeral 67 of the pre-registered patent) is fixed to an upper end of the driven pulley C by using a fastening bolt E (for example, hexagonal bolt) or the like. In this case, when the driven pulley C is used for a long time, there is a problem that the driven pulley C is separated from the rotating shaft portion A or violently moves in the directions of arrows in FIG. 2. Therefore, due to the problems, the three-dimensional wave generating device does not operate properly or a coupling state becomes unstable, and thus, many A/S requests have come from consumers.

DISCLOSURE

Technical Problem

The present invention is directed to providing a three-dimensional wave generating device and a multifunctional motion bed having the same, in which a safety device is provided, which prevents a driven pulley and/or a driven pulley to which an eccentric shaft is coupled from being separated from a rotating shaft portion, and thus, operation stability is secured while noise caused by separation or unstable coupling of the driven pulley and/or eccentric shaft in a three-dimensional wave generating device is prevented from occurring, and when a functional motion bed to which the three-dimensional wave generating device is applied is provided, the user can feel a three-dimensional wave more effectively in bed.

Technical Solution

One aspect of the present invention provides a multifunctional motion bed including: a main mat supported by a frame and located at a lower portion; a bendable auxiliary mat placed on the main mat and located at an upper portion; a first air cell module connected to upper end portions of the main mat and auxiliary mat and inflated or deflated depending on whether air is supplied to adjust a deployment angle of the upper end portion of the bendable auxiliary mat; and a three-dimensional wave generator formed inside the main mat and configured to generate three-dimensional waves and transmit the generated three-dimensional waves to the auxiliary mat, in which the three-dimensional wave generator includes: a housing to which a noise-preventing fixed frame, from which first, second, and third rotating shaft portions protrude, is coupled; a driver coupled to one end of the fixed frame and having a drive pulley; a third driven pulley rotatably coupled to the third rotating shaft portion, which protrudes from a center of the fixed frame, through a bearing; first and second driven pulleys rotatably coupled to the first and second rotating shaft portions, which protrude from the other end of the fixed frame, through a bearing, to have a triangular arrangement structure with the third driven pulley; a power transmission belt connecting the drive pulley to each of the first to third driven pulleys; an eccentric shaft coupled to an upper surface of the third driven pulley and eccentrically rotated according to a rotation of the third driven pulley; a fixing portion formed on an upper surface of the eccentric shaft; and a vibration plate in close contact with a bottom surface of the auxiliary mat while being coupled to the fixing portion and configured to generate a three-dimensional wave through vibration of an upward-downward movement according to an eccentric rotation of the eccentric shaft and transmit the generated three-dimensional wave to the auxiliary mat, a first screw portion and a first locking groove are formed at an upper end of the first rotating shaft portion, and a safety member locked to the first locking groove to prevent rotation is fastened to the first screw portion so that the third driven pulley fit-coupled through a bearing is prevented from being separated from the third rotating shaft portion.

The safety member may include: a first safety ring fitted to an upper end of the third rotating shaft portion and having a first locking wing formed on an inner peripheral surface and at least one bendable second locking wing formed on an outer peripheral surface; and a second safety ring disposed above the first safety ring at the upper end of the third rotating shaft portion and having a second screw portion formed on an inner peripheral surface to be fastened to the first screw portion and at least one second locking groove formed on an outer peripheral surface, the first locking wing may be locked and fixed to the first locking groove to prevent rotational loosening of the first and second screw portions, and the second locking wing may be locked and fixed to the second locking groove while being bent to prevent the rotational loosening of the first and second screw portions.

Lower end portions of the main mat and the auxiliary mat may be connected by a second air cell module configured to adjust a deployment angle of the lower end portion of the auxiliary mat.

The first air cell module and the second air cell module may have the same structure and may be formed by stacking one or more air cells, one ends of the stacked air cells may be bonded and then fixed to the main mat and auxiliary mat, and the other ends of the air cells may be separated to be inflated when air is supplied to an inside of each of the air cells, and the other ends of the air cells may be connected by an air support rod which is deflated by the air supplied into the air cells to support the air cell.

A third air cell module, which is inflated or deflated depending on whether air is supplied for air massage and stretching with respect to each portion of a body, may be provided inside the auxiliary mat.

In the third air cell module, a pocket portion may be disposed inside the auxiliary mat to correspond to each portion of the body, and an inflatable or deflatable air cell may be provided in the pocket portion.

A correction member configured to correct vertical upright states of the first and second rotating shaft portions may be formed on the fixed frame.

The correction member may include: a fixing block fixed to the fixed frame by a screw; and a correction screw supporting the first and second rotating shaft portions while passing through the fixing block.

The first driven pulley may include a first-stage pulley portion connected to the drive pulley through a belt and a second-stage pulley portion connected to the second driven pulley through a belt, and a diameter of the first-stage pulley portion may be larger than a diameter of the second-stage pulley portion.

The second driven pulley may include a first-stage pulley portion connected to the second-stage pulley portion of the first driven pulley through a belt and a second-stage pulley portion connected to the third driven pulley through a belt, and a diameter of the first-stage pulley portion may be larger than a diameter of the second-stage pulley portion.

The first-stage pulley portions of the first and second driven pulleys may have the same diameter, the second-stage pulley portions of the first and second driven pulleys may have the same diameter, and a diameter of the third driven pulley may be larger than the diameters of the first-stage pulley portions of the first and second driven pulleys.

A multi-stage belt groove divided into multi-stage partition walls may be formed in each of the drive pulley and the second-stage pulley portion, and a groove portion and a wing portion seated at the partition wall and the belt groove may be formed at one surface of the belt to prevent movement caused by rotation.

The eccentric shaft may include: a disk-shaped fixing body formed at a center of the upper surface of the third driven pulley and having an equal height; an eccentric disk coupled to an upper surface of the fixing body by a fastening member and including one end and the other end having heights different from each other; and an eccentric shaft portion which is formed at a center of an upper surface of the eccentric disk and to which the fixing portion is coupled through a fastening member.

The vibration plate may include a central portion fixed to the fixing portion through a fastening member, a disk portion at an angle inclined in a first direction from the central portion, and an edge portion at an angle inclined in a second direction opposite to the first direction from the disk portion.

The first to third air cell modules may be connected to an electric pump or a manual pump through a connection hose.

When the first to third air cell modules are connected to the electric pump through the connection hose, a controller may control the electric pump to be turned on or off.

For driving of the driver, the driver may be controlled to be turned on or off by the controller, and a control program that sequentially controls the electric pump and the driver to be turned on or off may be installed in the controller, and the control program may be executed according to an operation condition of a user made through an input unit or a set time made by a timer.

The three-dimensional wave generator may interwork with a sound generator, and the sound generator may operate and output a sound according to a control signal of the controller prior to operation of the three-dimensional wave generator.

The sound generator may include a TV or audio which is an electronic product allowing at least a sound to be output.

Advantageous Effects

According to the present invention, a safety device is provided, which prevents a driven pulley and/or a driven pulley to which an eccentric shaft is coupled from being separated from a coupling shaft. Therefore, operation stability is secured while noise caused by separation or unstable coupling of the driven pulley and/or eccentric shaft in a three-dimensional wave generating device is prevented from occurring, and when a functional motion bed to which the three-dimensional wave generating device is applied is provided, the user can feel a three-dimensional wave more effectively in the bed.

Effects of the present invention are not limited to the above-mentioned effects, and other effects that are not mentioned will be clearly understood by those skilled in the art from descriptions of claims.

BEST MODE OF THE INVENTION

Figure 1:
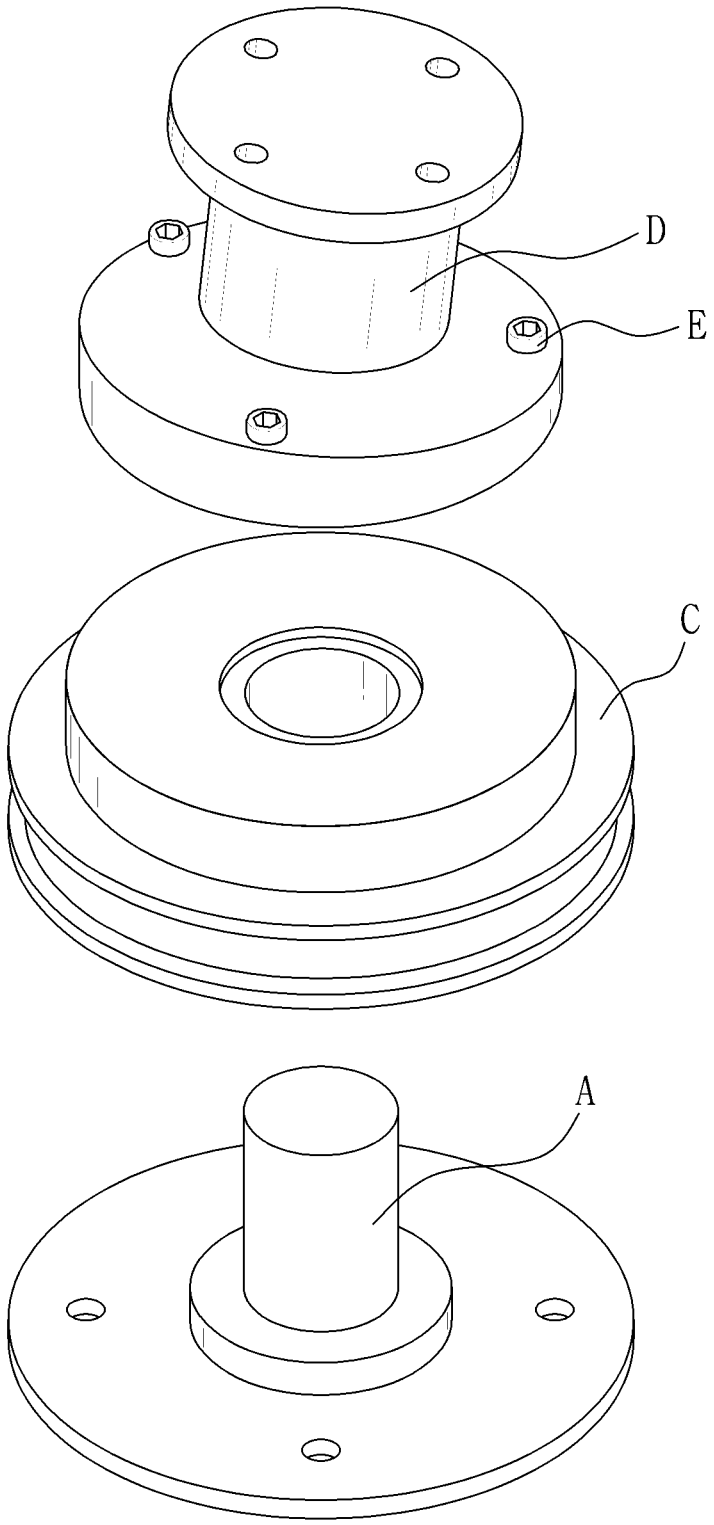
FIG. 1 is a schematic cross-sectional view illustrating a separation state of a driven pulley and an eccentric shaft of a pre-registered patent.
Figure 2:
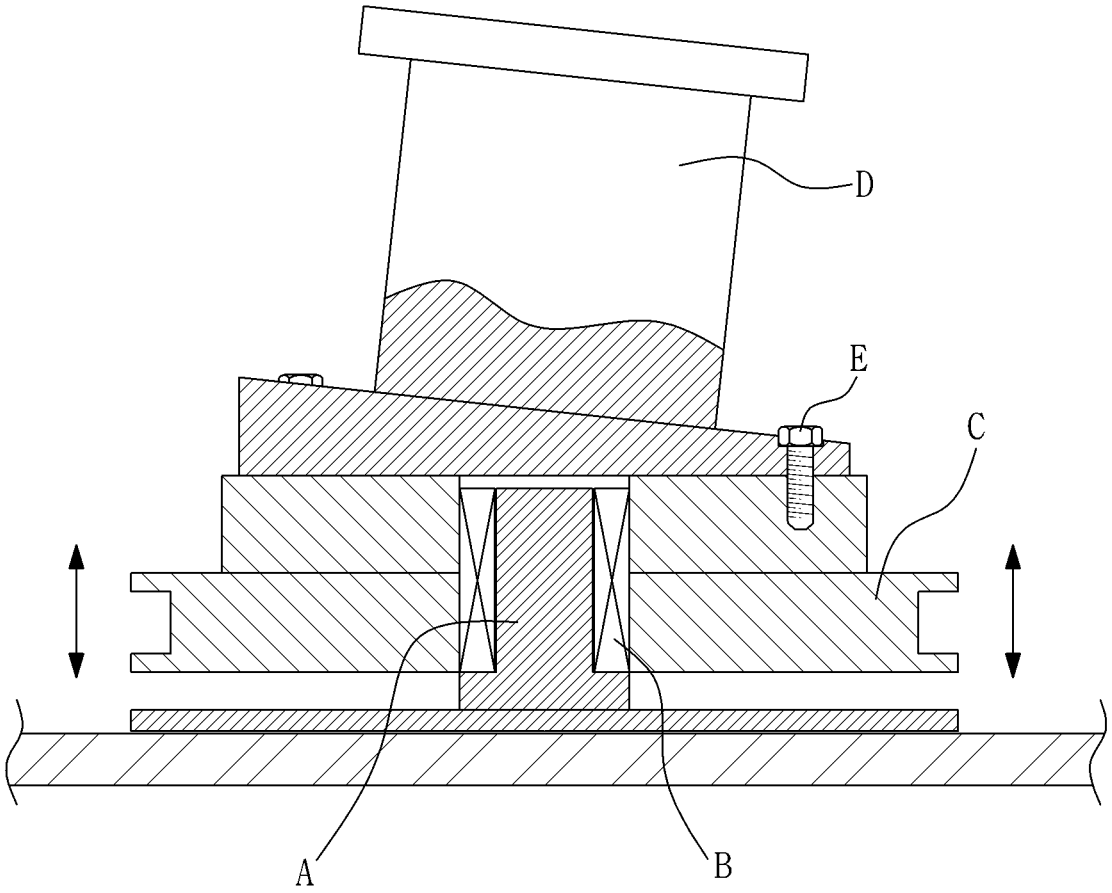
FIG. 2 is a schematic cross-sectional view illustrating a coupling state of the driven pulley and the eccentric shaft of the pre-registered patent.

Advantages and features of the present invention and a method of achieving them will become apparent with reference to embodiments described below in detail together with the accompanying drawings. However, in the embodiment of a technical idea of the present invention, it is not limited to the embodiments disclosed below but may be implemented in various different forms. That is, only the present embodiment is provided to complete a disclosure of the present invention and to completely inform the scope of the invention to those of ordinary skill in the art, to which the present invention pertains, and is only defined by the scope of the claims in the embodiment of the technical idea of the present invention.

Terms used in the present specification are for describing the embodiments and are not intended to limit the present invention. In the present specification, a singular form also includes a plural form unless specifically stated in a phrase.

In the present specification, it should be understood that terms such as "include" and "have" are intended to designate the presence of features, numbers, steps, actions, components, parts, or combinations thereof described in the specification and do not preclude possibility of presence or addition of one or more other features, numbers, steps, actions, components, parts, or combinations thereof.

In addition, the embodiments described in the present specification will be described with reference to cross-sectional views and/or plan views, which are exemplary diagrams of the present invention. Accordingly, the embodiments of the present invention are not limited to an illustrated specific form but also include changes in necessary form. For example, an area illustrated at a right angle may be rounded or may have a shape having a predetermined curvature. Accordingly, regions illustrated in the drawings have schematic properties, and shapes of the regions illustrated in the drawings are for illustrating a specific shape of a region of the device and are not intended to limit the scope of the invention.

The same reference numerals refer to the same constituent elements throughout the entire specification. Accordingly, the same reference numerals or similar reference numerals may be described with reference to other drawings, even when they are not mentioned or described in the corresponding drawings. Further, even when a reference numeral is not indicated, it may be described with reference to other drawings.

Hereinafter, embodiments of the present invention will be described with reference to the accompanying drawings.

With reference to FIGS. 3 to 23, a multifunctional motion bed according to embodiments of the present invention includes a main mat 10, an auxiliary mat 20, and a first air cell module 30 and, in addition, may further include a second air cell module 40, a third air cell module 50, a three-dimensional wave generator 60, an electric pump 70 and/or a manual pump 80, and a controller 90.

Figure 3:
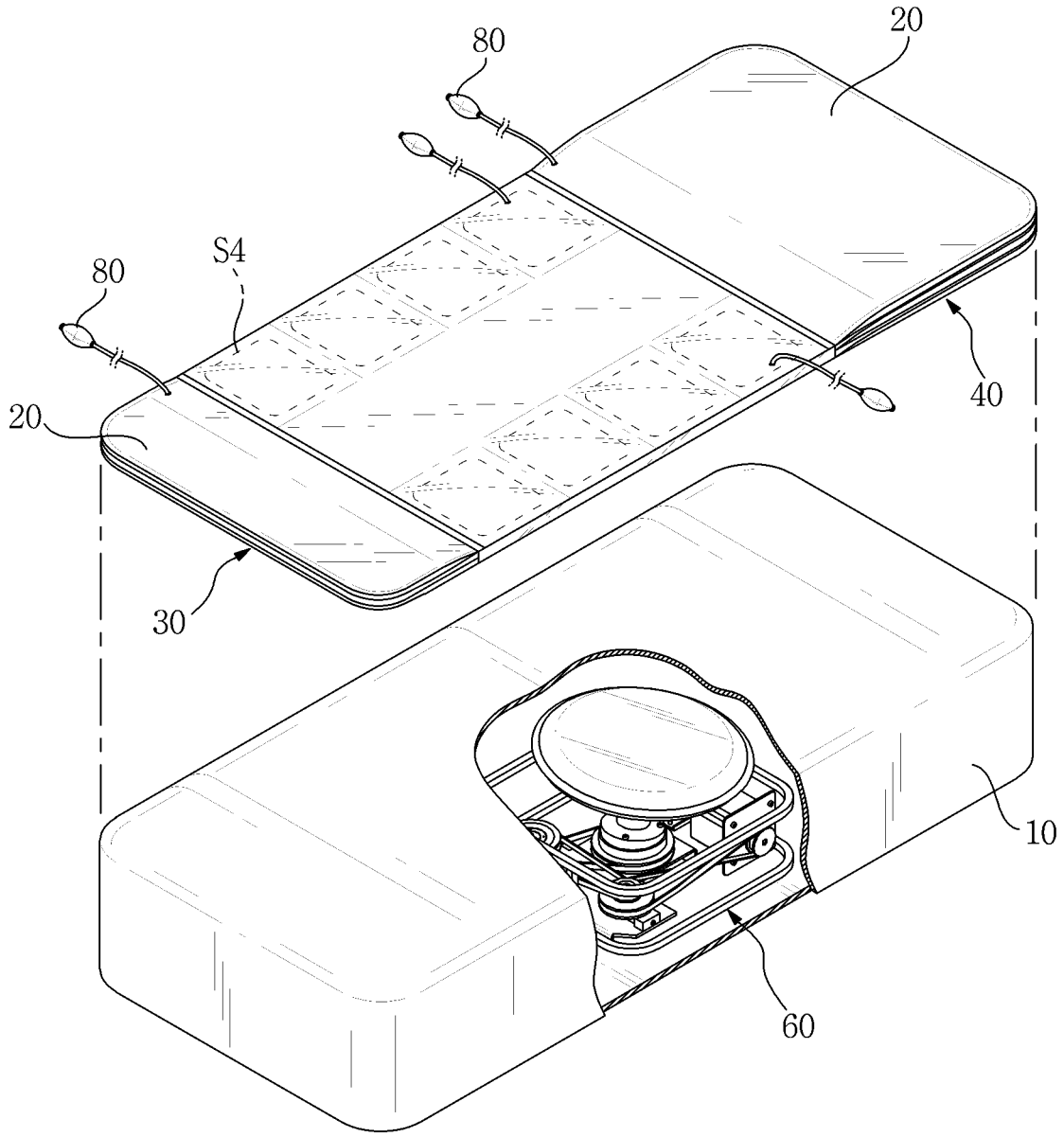
FIG. 3 is an exploded perspective view illustrating a structure of a multifunctional motion bed according to one embodiment of the present invention.

As illustrated in FIG. 3, the main mat 10 uses a general bed mat supported by a frame.

As illustrated in FIG. 3, the auxiliary mat 20 is placed on the main mat 10. The auxiliary mat 20 may be bent without using a frame, but an elastic frame may be applied to the inside of the auxiliary mat 20 to allow bending.

Here, a thickness of the auxiliary mat 20 is smaller than that of the main mat 10 and, preferably, is ¼ of the thickness of the main mat 10, but it is not necessarily limited to this thickness. That is, any thickness may be allowed as long as the auxiliary mat 20 can be bent.

As illustrated in FIGS. 3 and 17 to 23, the first air cell module 30 connects an upper end portion of the main mat 10 to the auxiliary mat 20 and is inflated or deflated depending on whether air is supplied to adjust a deployment angle of the upper end portion of the bendable auxiliary mat 20. To this end, one or more air cells S1, S3, and S3 may be stacked, and one ends of the stacked air cells S1, S2, and S3 may be bonded to each other and then fixed to the main mat 10 and the auxiliary mat 20. The other ends of the air cells S1, S2, and S3 are inflated to be separated from each other when air is supplied to the insides of the air cells S1, S2, and S3, and the opposite ends of the air cells S1, S2, and S3 are inflated by the air supplied to the insides of the air cells S1, S2, and S3 and connected to each other by air support rods 31 supporting the air cells S1, S2, and S3.

That is, at a head portion of the bed, one end of the first air cell module 30 may be connected and fixed to the main mat 10 and the auxiliary mat 20, and the other end thereof may be separated to be inflated when air is supplied. When the air cells S1, S2, and S3 are inflated, the upper end of the auxiliary mat 20 may move away from the main mat 10 while being bent. Accordingly, the upper end portion of the auxiliary mat 20 may perform a backrest function to support a back of a user in bed.

In the respective one ends of the air cells S1, S2, and S3, an air inlet (not illustrated) is formed in any one of the air cells S1, S2, and S3, and the electric pump 70 or manual pump 80 is connected to the air inlet through a connection hose so that air can be injected into the air cells S1, S2, and S3. The injected air is sequentially supplied to an inner space of other air cells through a flow path in the air support rod 31, and thus, the air support rod 31 can support the opposite ends of the inflated air cells S1, S2, and S3.

Meanwhile, the configuration in which one first air cell module 30 is provided between the main mat 10 and the auxiliary mat 20 is described. However, one or more first air cell modules 30 may be provided. One or more air cell modules 30 may be selectively applied depending on the width and length of the bed.

The second air cell module 40 may support a lower end of the auxiliary mat 20, that is, a leg of the user when the user lies in bed. A structure of the second air cell module 40 is the same as that of the first air cell module 30 having the air cells S1 and S2, and thus, detailed descriptions thereof will be omitted below.

The third air cell module 50 may be formed inside the auxiliary mat 20 to correspond to each portion of the body (for example, shoulders, back, waist, pelvis, thighs, knees, calves, or the like). The third air cell module 50 provides an air massage and stretching effect for each portion of the body while being inflated or deflated depending on whether air is supplied or not, an air cell S4 is formed in a pocket portion 51, and an air inlet (not illustrated) is formed at the air cell S4.

That is, the pocket portions 51 are formed inside the auxiliary mat 20, and the number the pocket portions 51 corresponds to the number of portions of the body. Thereafter, in a state in which the air cells S4 are accommodated in the pocket portions 51, all or some air cells S4 are inflated by the electric pump or the manual pump 80 to provide air massage and stretching effects while raising all or specific portions of the body. Hereinafter, inflation and deflation states of the third air cell module 50 according to whether air is supplied are the same as those of the first air cell module 30, and thus, repeated descriptions thereof will be omitted.

The three-dimensional wave generator 60 may be installed at an inner center of the main mat 10 as illustrated in FIGS. 3 to 16. An upper side of the three-dimensional wave generator 60 is in close contact with the auxiliary mat 20 to generate a three-dimensional wave transmitted to the auxiliary mat 20, and the three-dimensional wave generator 60 may include a housing 61, a driver 62, first to third driven pulleys 63, 64, and 65, a belt 66, an eccentric shaft 67, a fixing portion 68, and a vibration plate 69.

The housing 61 is a structure formed by coupling frames, and the driver 62 is a motor in which a drive pulley 62*a* is coupled to a drive shaft (not illustrated).

The drive pulley 62*a* is connected to the first driven pulley 63 through the belt 66 and rotates in a vertical direction.

The first to third driven pulleys 63, 64, and 65 may be disposed to be coplanar in the driver 62. The housing 61 is provided with a fixed frame 61*a*, and first to third rotating shaft portions 61*b*, 61*b*', and 61*b*" for horizontal rotation of the first to third driven pulleys 63, 64, and 65 are formed on the fixed frame 61*a*.

Figure 4:
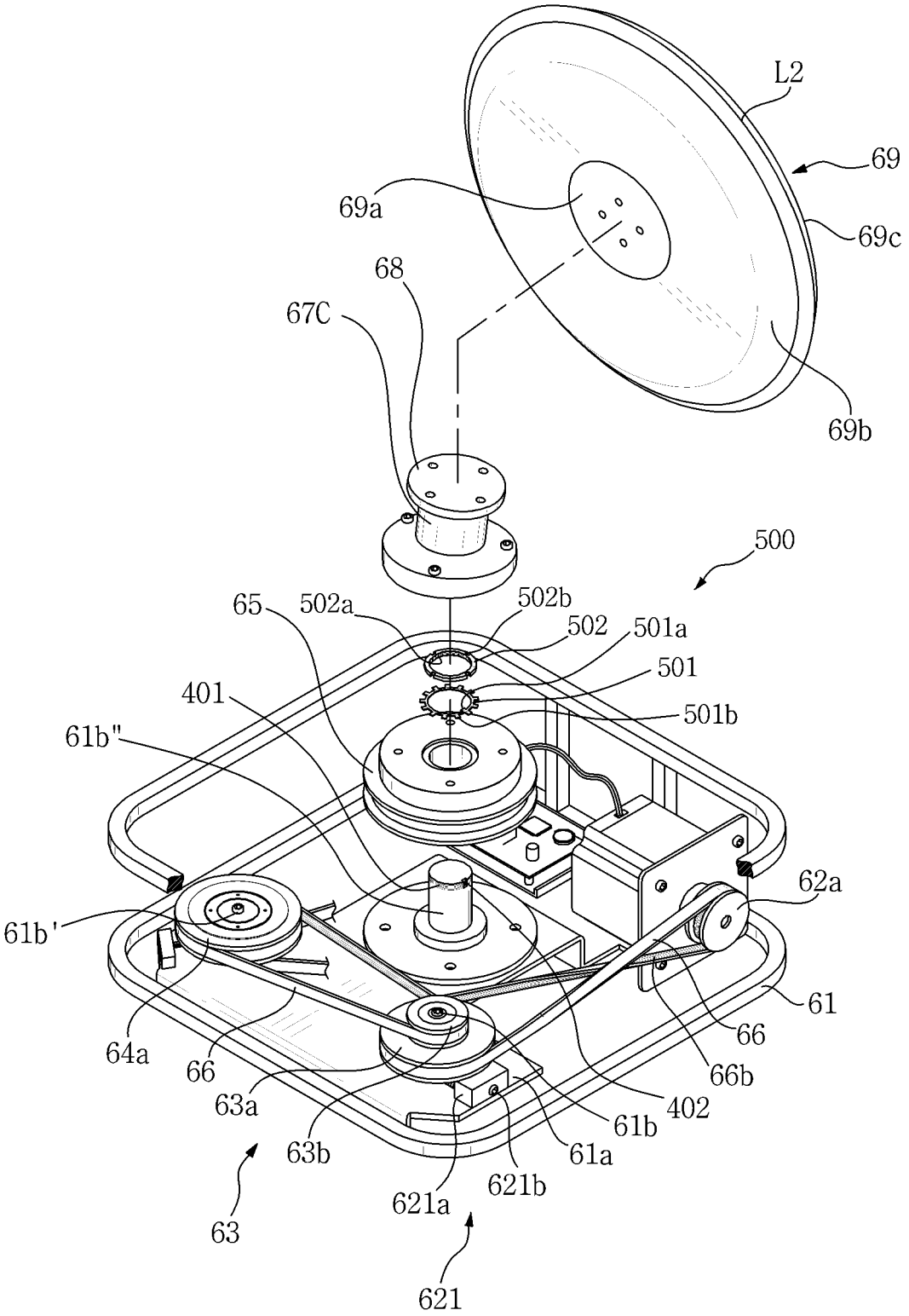
FIG. 4 is an exploded view illustrating a structure of a three-dimensional wave generating device according to one embodiment of the present invention.
Figure 5:
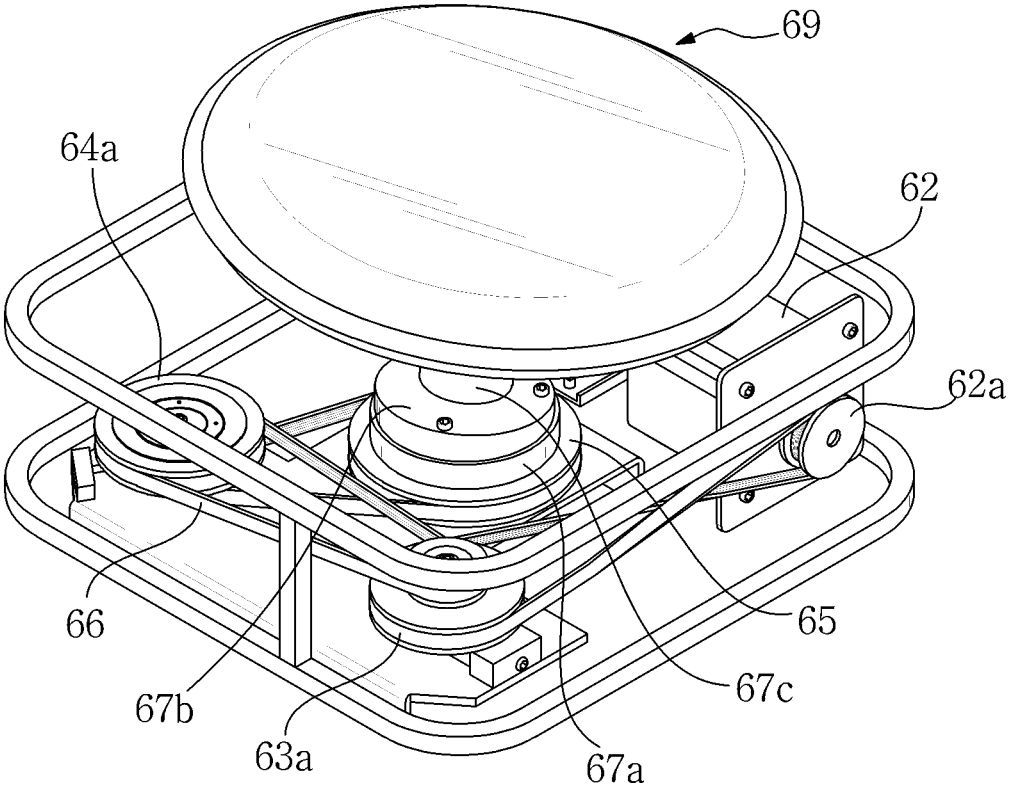
FIG. 5 is a combined view illustrating the structure of the three-dimensional wave generating device according to one embodiment of the present invention.
Figure 6:
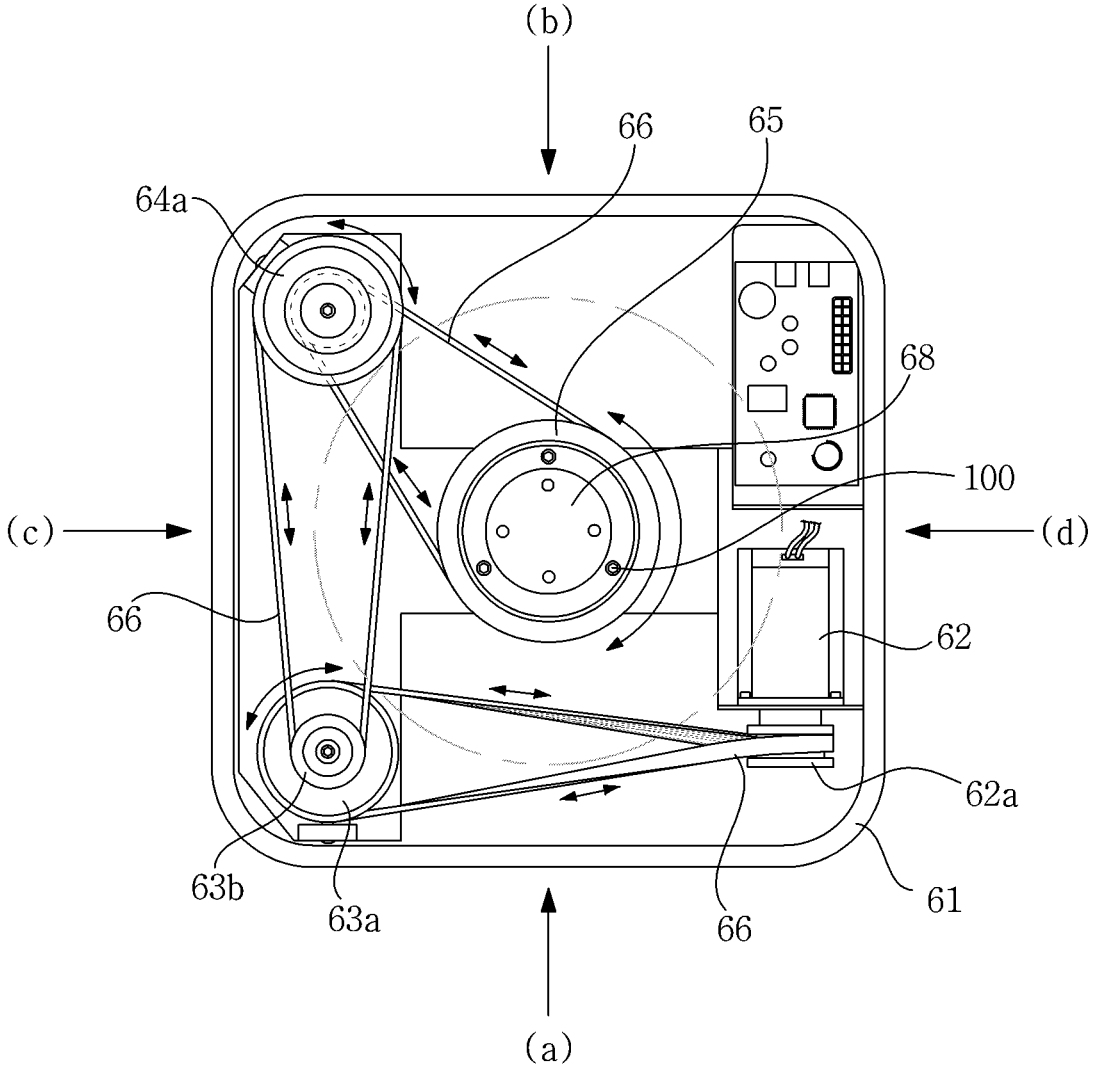
FIG. 6 is a plan view illustrating the structure of the three-dimensional wave generating device according to one embodiment of the present invention.
Figure 7:
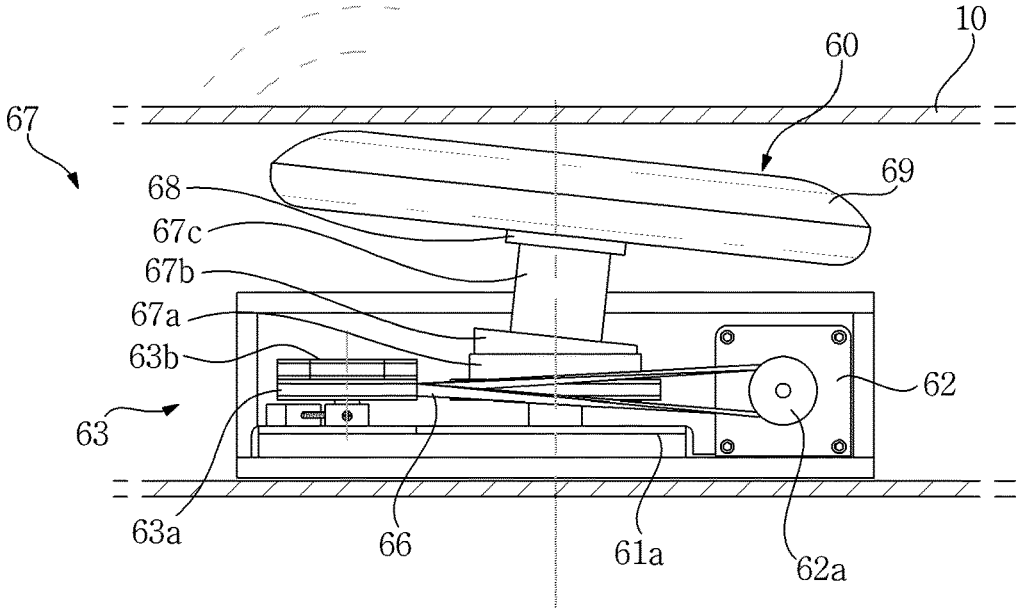
FIG. 7 is a view viewed from a direction (a) of FIG. 6 when the three-dimensional wave generating device is operated according to one embodiment of the present invention.
Figure 8:
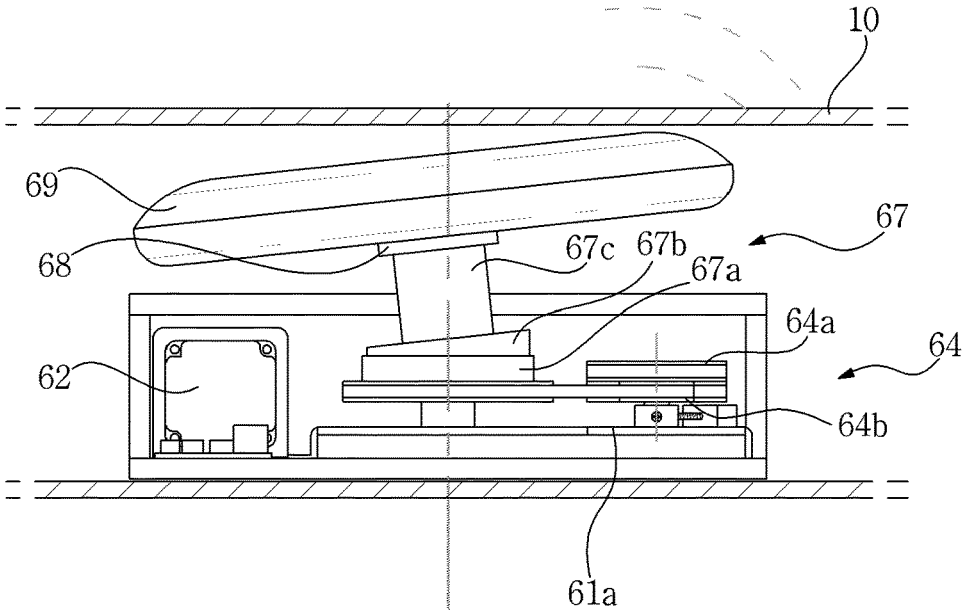
FIG. 8 is a view viewed from a direction (b) of FIG. 6 when the three-dimensional wave generating device is operated according to one embodiment of the present invention.
Figure 9:
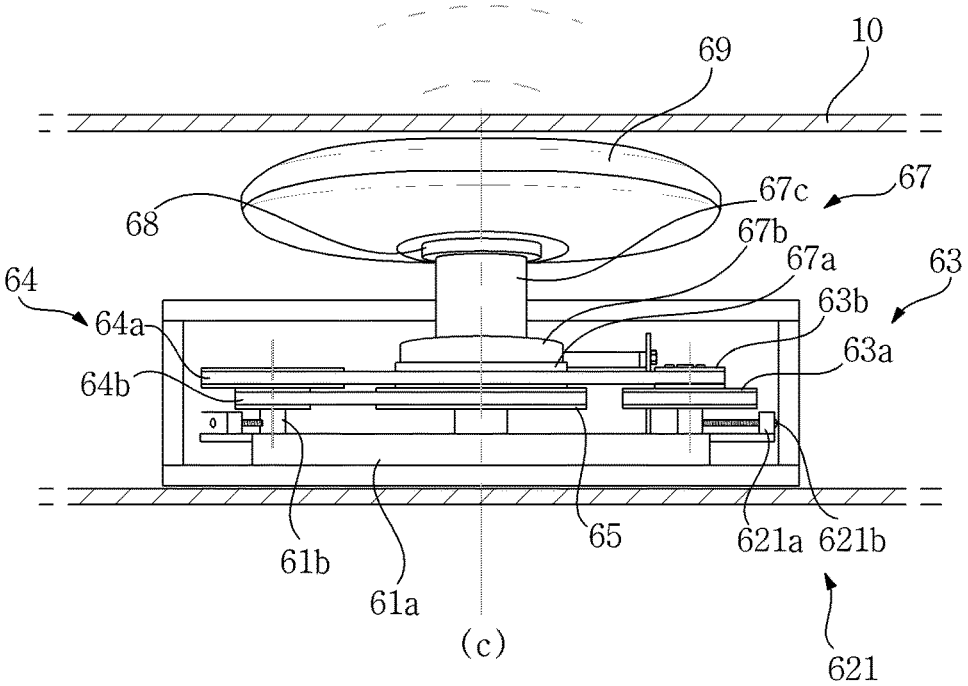
FIG. 9 is a view viewed from the direction (c) of FIG. 6 when the three-dimensional wave generating device is operated according to one embodiment of the present invention.
Figure 10:
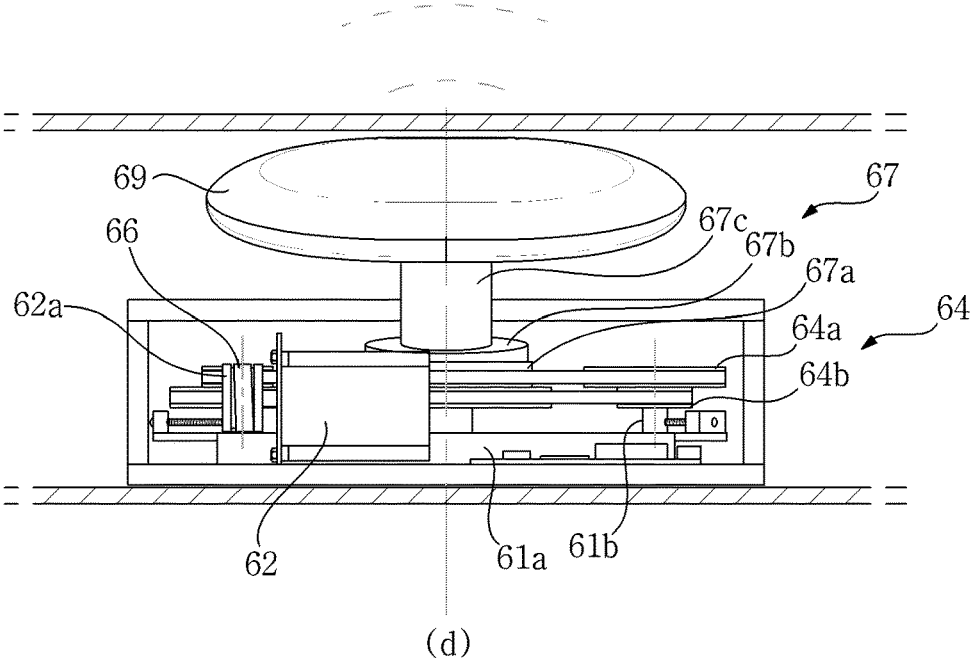
FIG. 10 is a view viewed from the direction (d) of FIG. 6 when the three-dimensional wave generating device is operated according to one embodiment of the present invention.
Figure 11:
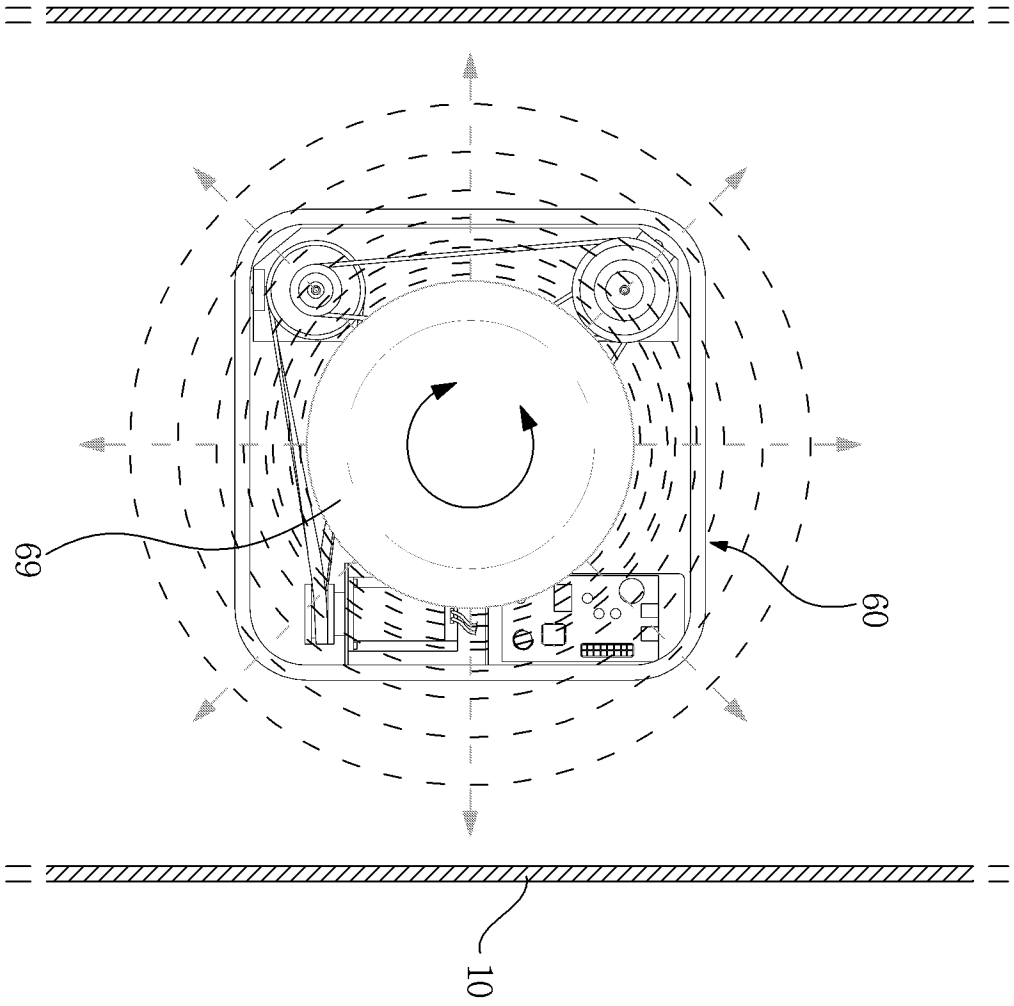
FIG. 11 is a schematic plan view illustrating a generated flow of three-dimensional waves when the three-dimensional wave generating device is operated according to one embodiment of the present invention.

As illustrated in FIG. 4, the third driven pulley 65 may be disposed at a center of the fixed frame 61*a*. The first and second driven pulleys 63 and 64 may have a triangular arrangement structure with the third driven pulley 65 at one end of the fixed frame 61*a* to prevent noise when a driving force of the driver 62 is transmitted.

The first to third driven pulleys 63, 64, and 65 to which a bearing B is coupled may be fit-coupled to the first to third rotating shaft portions 61*b*, 61*b*', and 61*b*", respectively. In the fit-coupling, when the third driven pulley 65 is used for a long period of time, a coupling force thereof is weakened, and there is problem that the third driven pulley 65 is moved or separated from the third rotating shaft part 61*b*".

Accordingly, in one embodiment of the present invention, a first screw portion 401 and a first locking groove 402 may be formed at an upper end of the third rotating shaft portion 61*b*". In order to prevent the third driven pulley 65 fit-coupled through the bearing B from being moved or separated from the third rotating shaft portion 61*b*", a safety member 500, which is locked to the first locking groove 402 to prevent rotation, is fastened to the first screw portion 401.

As illustrated in FIGS. 4 and 12 to 14, the safety member 500 may include first and second safety rings 501 and 502. The first safety ring 501 is fitted to an upper end of the third rotating shaft portion 61*b*", and first locking wings 501*a* fitted and fixed to the first locking grooves 402 may be formed on an inner peripheral surface of the first safety ring 501. At least one bendable second locking wing 501*b* may be formed on an outer peripheral surface of the first safety ring 501.

The second safety ring 502 includes a second screw portion 502*a* which is formed to be fastened to the first screw portion 401 so that the second safety ring 502 is stacked on the first safety ring 501 at the upper end of the third rotating shaft portion 61*b*". In addition, one or more second locking grooves 502*b* may be formed on an outer peripheral surface of the second safety ring 502.

Accordingly, the first locking wing 501*a* formed on the first safety ring 501 may be locked and fixed to the first locking groove 402, and the second locking wing 501*b* may be bent to be locked and fixed to the second locking groove 502*b*. Due to the locking and fixing operation as described above, the second safety ring 502 can be prevented from being rotated and released, and the first and second safety rings 501 and 502 can be prevented from being separated from the upper end portion of the third rotating shaft portion 61*b*". The third driven pulley 65, which is forcibly fitted to the third rotating shaft portion 61*b*" through the bearing B, can be stably rotated in a state in which movement and separation due to the movement are prevented.

A correction member 621 for correcting vertical upright states of the first and second rotating shaft portions 61*b* and 61*b*' may be formed on the fixed frame 61*a*. The correction member 621 includes a fixing block 621*a* that is fixedly screwed to the fixed frame 61*a* and a correction screw 621*b* that supports each of the first and second rotating shaft portions 61*b* and 61*b*' while passing through the fixing block 621*a*.

The belt 66 transmits power and connects the drive pulley 62*a* to the first to third driven pulleys 63, 64, and 65.

The first to third driven pulleys 63, 64, and 65 rotate at different turning rates to reduce noise caused by the transmission of the driving force of the driver 62.

Accordingly, the first driven pulley 63 includes a first-stage pulley portion 63*a* that is connected to the drive pulley 62*a* through the belt 66 and a second-stage pulley portion 63*b* that is connected to the second driven pulley 64 through the belt 66, and a diameter of the first-stage pulley portion 63*a* is larger than a diameter of the second-stage pulley portion 63*b*.

The second driven pulley 64 includes a first-stage pulley portion 64*a* that is connected to the second-stage pulley portion 63*b* of the first driven pulley 63 through the belt 66 and a second-stage pulley portion 64*b* that is connected to the third driven pulley 65 through the belt 66, and a diameter of the first-stage pulley portion 64*a* is smaller than a diameter of the second-stage pulley portion 63*b*.

The first-stage pulley portions 63*a* and 64*a* of the first and second driven pulleys 63 and 64 have the same diameter, and the second-stage pulley portions 63*b* and 64*b* of the first and second driven pulleys 63 and 64 have the same diameter, and a diameter of the third driven pulley 65 is larger than the diameter of each of the first-stage pulley portions 63*a* and 64*a* of the first and second driven pulleys 63 and 64.

Meanwhile, when the drive pulley 62*a* is connected to the first-stage pulley portion 63*a* of the first driven pulley 63 through the belt 66, the second-stage pulley portion 63*b* of the first driven pulley 63 is connected to the first-stage pulley portion 64*a* of the second driven pulley 64 through the belt 66, and the second-stage pulley portion 64*b* of the second driven pulley 64 is connected to the third driven pulley 65 through the belt 66, the belt 66 may be worn due to long-term use, and thus, there is a problem that the belt 66 may move from the first-stage pulley portions 63*a* and 64*a* to generate noise, or in severe cases, the belt 66 may be separated from the first-stage pulley portions 63*a* and 64*a*.

Figure 15:
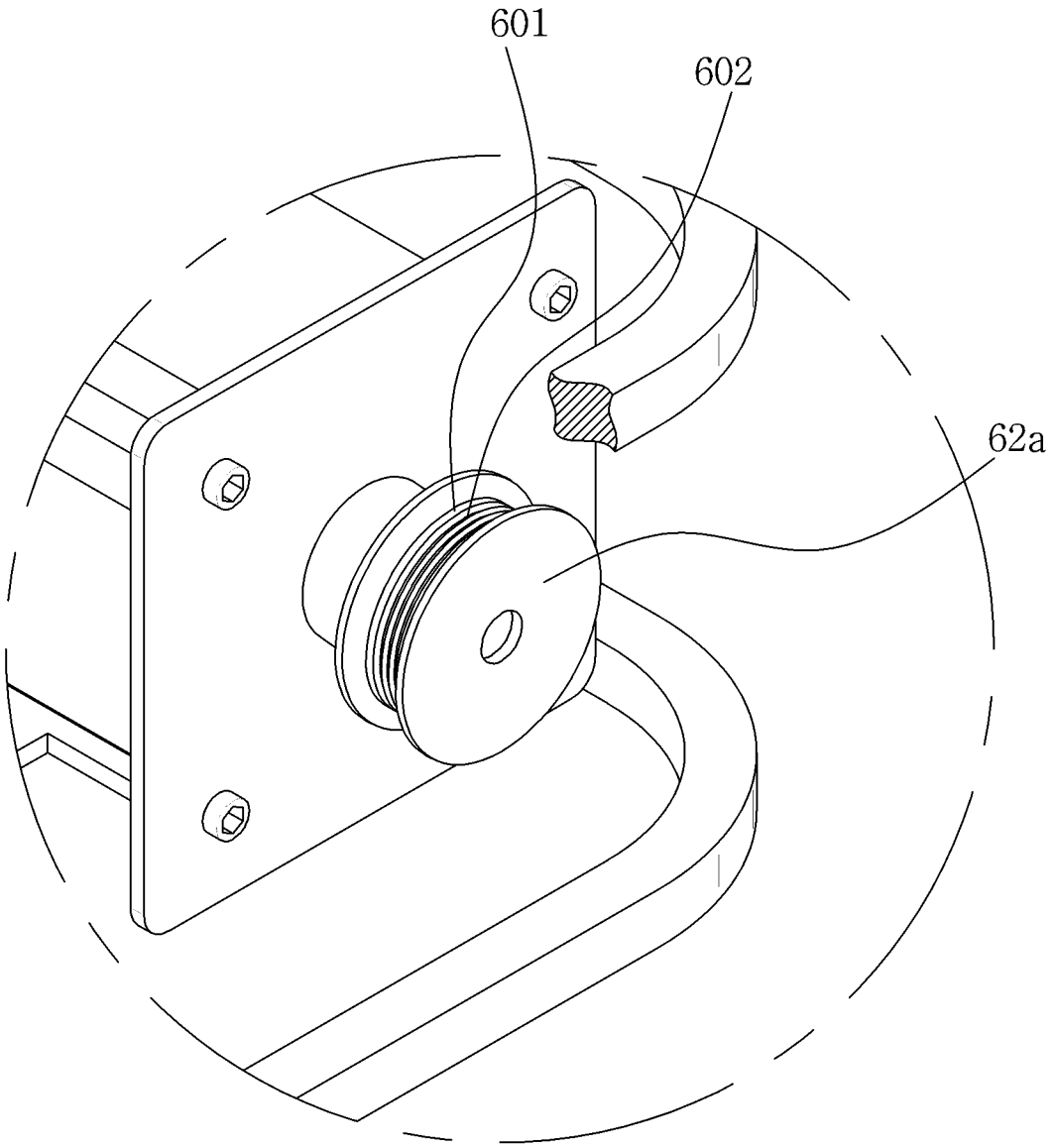
FIG. 15 is an enlarged perspective view illustrating a structure of a drive pulley in which a partition wall and a belt groove are formed according to one embodiment of the present invention.
Figure 16:
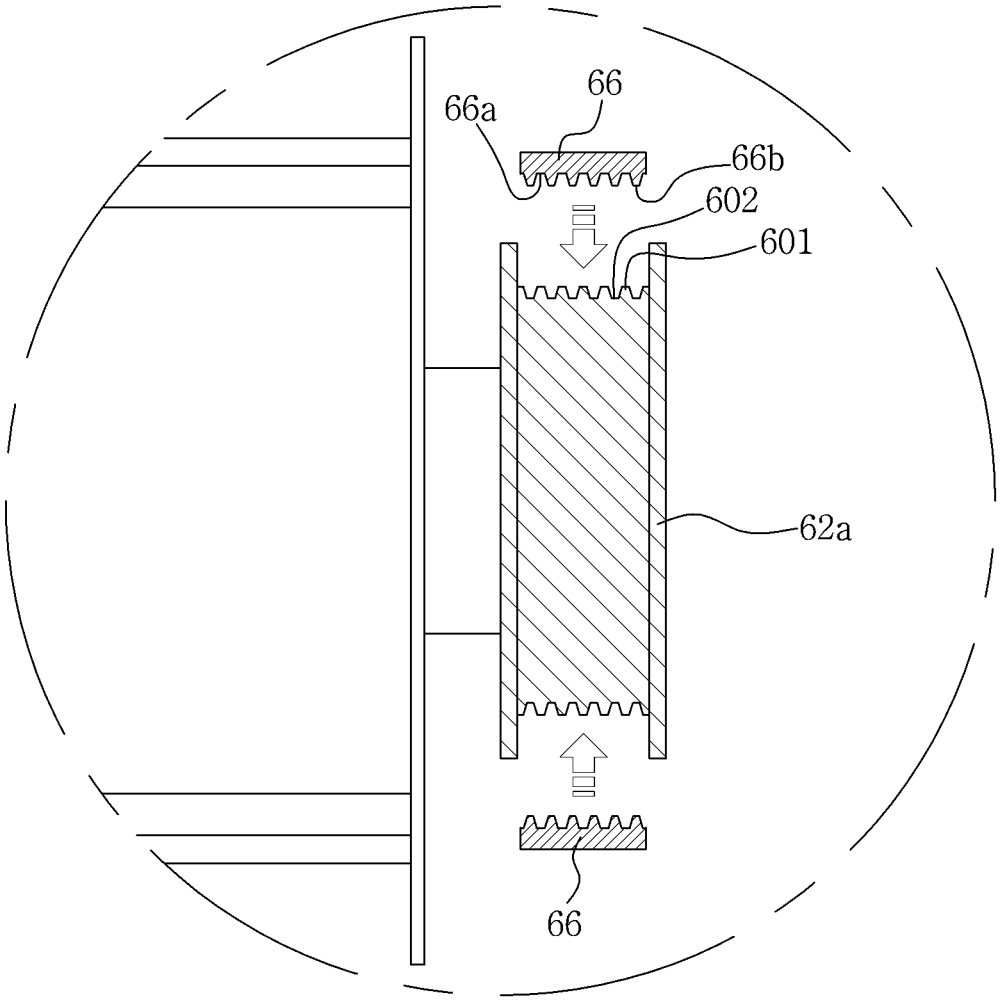
FIG. 16 is a schematic exploded cross-sectional view illustrating a state in which a belt having a groove portion and a wing portion is coupled to the drive pulley according to one embodiment of the present invention.

Accordingly, in the embodiment of the present invention, as illustrated in FIGS. 15 and 16, while a multi-stage belt groove 602 divided into multi-stage partition walls 601 is formed in each of the drive pulley 62*a* and the second-stage pulley portions 63*b* and 64*b* coupled to the first-stage pulley portions 63*a* and 64*a*, a groove portion 66*a* and a wing portion 66*b* seated on the partition wall 601 and the belt groove 602 are formed on one surface of the belt 66 to prevent the movement of the belt 66 caused by rotation.

Accordingly, the belt 66 can stably rotate on the drive pulley 62*a* and the second-stage pulley portions 63*b* and 64*b* in a state where the movement of the belt 66 is prevented, and thus, the noise caused by the movement of the belt 66 can be prevented, and the belt 66 can be also prevented from being separated.

Here, in the drawings according to the embodiment of the present invention, in the structure in which the belt 66 is connected to the drive pulley 62*a*, the partition wall 601 and the belt groove 602 are formed in the drive pulley 62*a* and the groove portion 66*a* and the wing portion 66*b* are formed in the belt 66. However, although not illustrated in the drawings, the partition wall 601, the belt groove 602, the groove portion 66*a*, and the wing portion 66*b* may be also formed in the second-stage pulley portions 63*b* and 64*b* of the first and second driven pulleys 63 and 64 and the belt 66 coupled to the second-stage pulley portions 63*b* and 64*b*.

Figure 12:
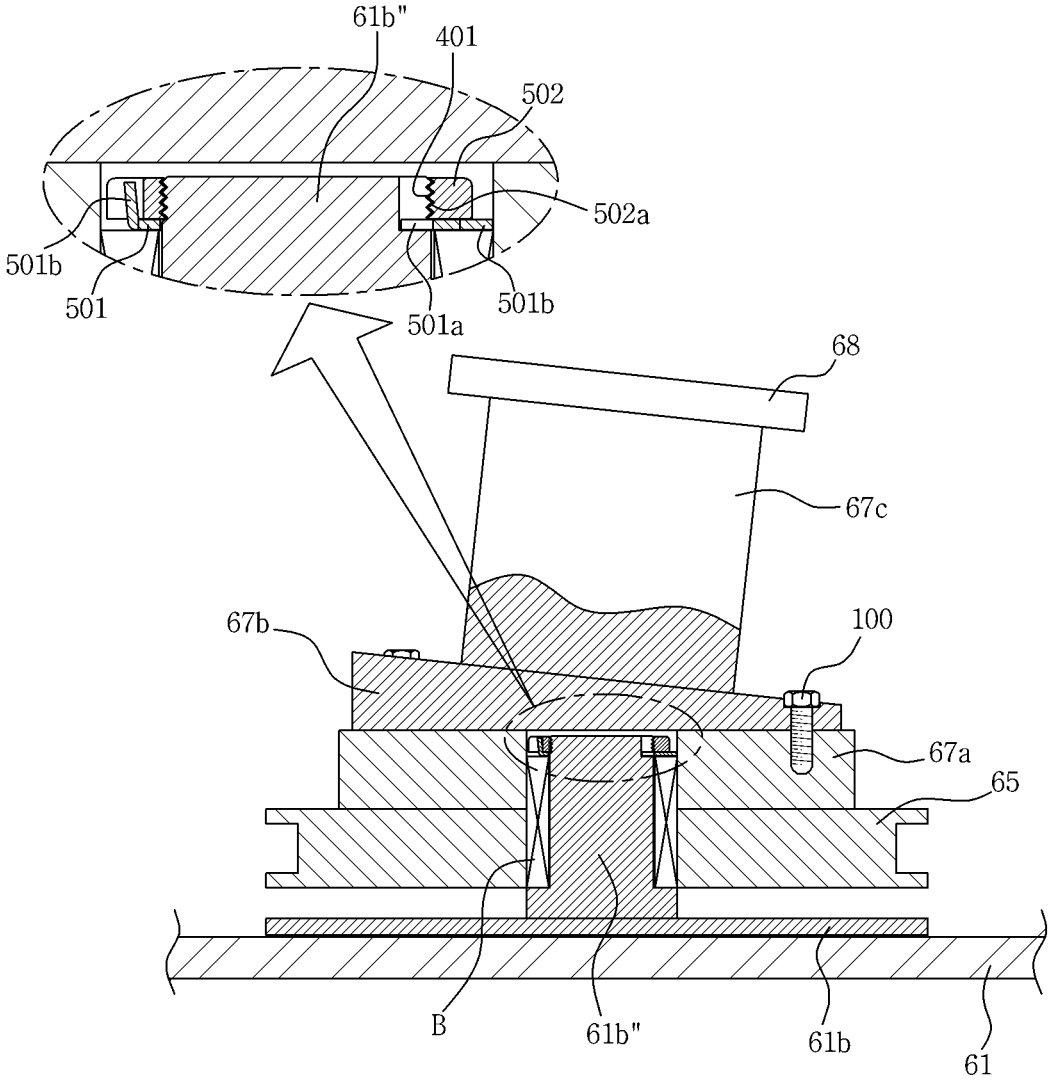
FIG. 12 is a schematic cross-sectional view of a state in which a safety member is coupled to a rotating shaft portion to which an eccentric shaft is coupled according to one embodiment of the present invention.
Figure 13:
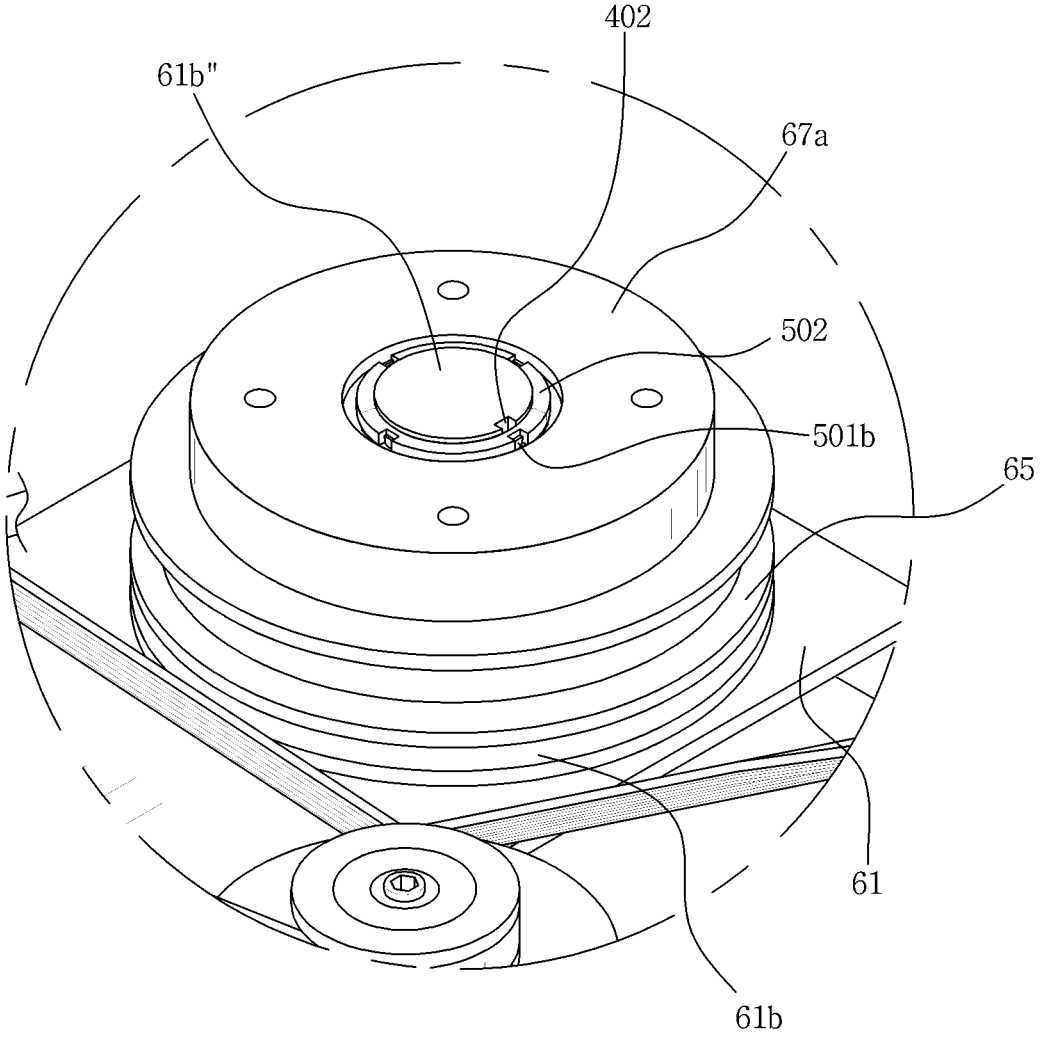
FIG. 13 is an enlarged perspective view of the state in which the safety member is coupled to the rotating shaft portion to which the eccentric shaft is coupled according to one embodiment of the present invention.
Figure 14:
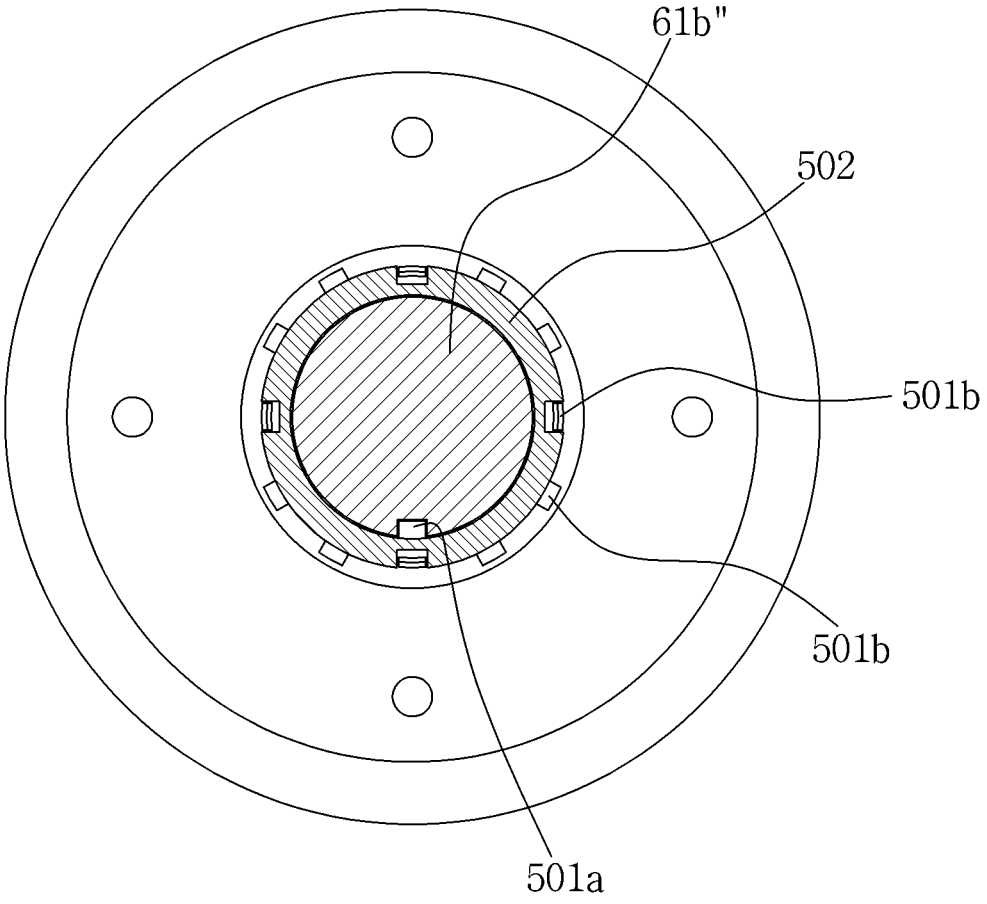
FIG. 14 is a schematic plan view of the state in which the safety member is coupled to the rotating shaft portion to which the eccentric shaft is coupled according to one embodiment of the present invention.

As illustrated in FIG. 12, the eccentric shaft 67 is formed on an upper surface of the third driven pulley 65, may be eccentrically rotated by the rotation of the third driven pulley 65 that maintains a stable coupling state so as not to be separated from the third rotating shaft portion 61*b*", and includes a disk-shaped fixing body 67*a*, an eccentric disk 67*b*, and an eccentric shaft portion 67*c*.

The disk-shaped fixing body 67*a* is a structure that is formed at a center of the upper surface of the third driven pulley 65 and has an equal height.

The eccentric disk 67*b* is coupled to the upper surface of the fixing body 67*a* by a fastening member 100, and one end and the other end thereof have different heights for generating eccentric rotation.

The eccentric shaft portion 67*c* is formed at a center of an upper surface of the eccentric disk 67*b*, and the fixing portion 68 is coupled through the fastening member 100 and is rotated eccentrically by the eccentric disk 67*b*.

The fixing portion 68 is coupled to the upper surface of the eccentric shaft 67 through a fastening member 100.

The vibration plate 69 is a disk-shaped structure and may be coupled to the fixing portion 68 using a fastening member 100 to be in close contact with a bottom surface of the auxiliary mat 20. According to the eccentric rotation of the eccentric shaft portion 67*c*, a three-dimensional wave is generated through vibrations of an upward-downward movement and transmitted to the auxiliary mat 20.

Here, the vibration plate 69 includes a central portion 69*a* that is fixed to the fixing portion 68 through the fastening member 100, a disk portion 69*b* that maintains an angle inclined in a first direction from the central portion 69*a*, and an edge portion 69*c* that maintains an angle inclined from the disk portion 69*b* in a second direction opposite to the first direction.

Accordingly, when the vibration plate 69 is rotated eccentrically by the eccentric shaft 67, a boundary portion L2 between the disk portion 69*b* and the edge portion 69*c* comes into direct contact with a bottom surface of the auxiliary mat 20, and the three-dimensional waves of the vibrations generated by the upward-downward movement may be transmitted to the auxiliary mat 20.

Here, the vibration plate 69 is described as being applied to the stacked structure of the main mat 10 and the auxiliary mat 20, but when the auxiliary mat 20 is not used, the vibration plate 69 may be in contact with an inner upper surface of the main mat 10.

Figure 23:
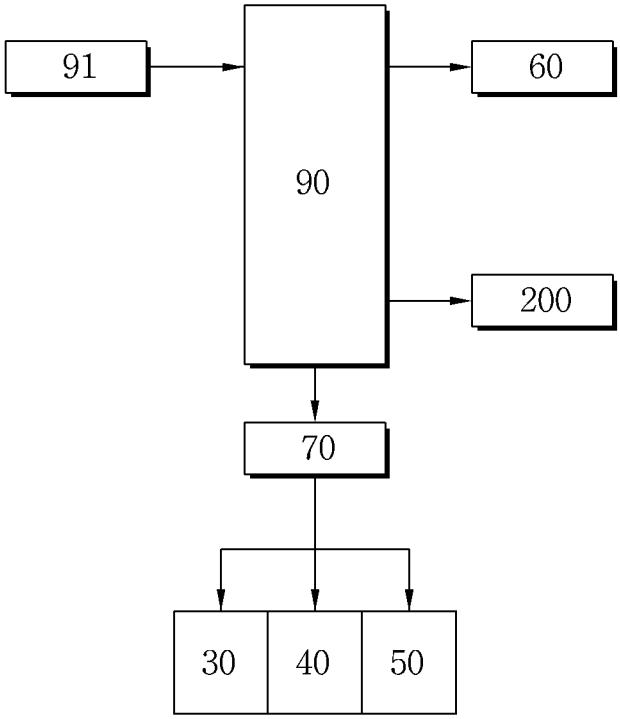
FIG. 23 is a schematic control block diagram of the multifunctional motion bed according to one embodiment of the present invention.

Meanwhile, as illustrated in FIG. 23, when the first to third air cell modules 30, 40, and 50 are connected to the electric pump 70 through the connection hose, the controller 90 may control the electric pump 70 to be turned on or off and control the driver 62 to be turned on or off. In the controller 90, a control program for sequentially controlling the electric pump 70 and the driver 62 to be turned on or off is installed, and the control program may be executed according to an operation condition of the user made through an input unit or a set time made by a timer 91.

The three-dimensional wave generator 60 may interwork with a sound generator 200 including a TV or audio which is an electronic product capable of outputting a sound. The sound generator 200 may operate and output a sound according to a control signal of the controller 90 prior to the operation of the three-dimensional wave generator 60, and the reason for outputting the sound first is to serve to a reminder of the operation of the three-dimensional wave generator 60.

That is, the user may know in advance that a wake-up time has come from the fact that the sound generator 200 operates and that the three-dimensional wave generator 60 will operate subsequently. This is to prevent a user who is in a deep sleep state from being surprised by the sudden operation of the three-dimensional wave generator 60.

[Modes of the Invention]

A multifunctional motion bed capable of performing air massage and posture conversion and generating three-dimensional waves according to one embodiment of the present invention will be described in more detail with reference to FIGS. 2 to 12, a posture conversion mode, an air massage and stretching mode, and a three-dimensional wave mode may be selectively performed or the plurality of modes may be simultaneously performed, and hereinafter, each mode will be described.

[Posture Conversion Mode]

Figure 17:
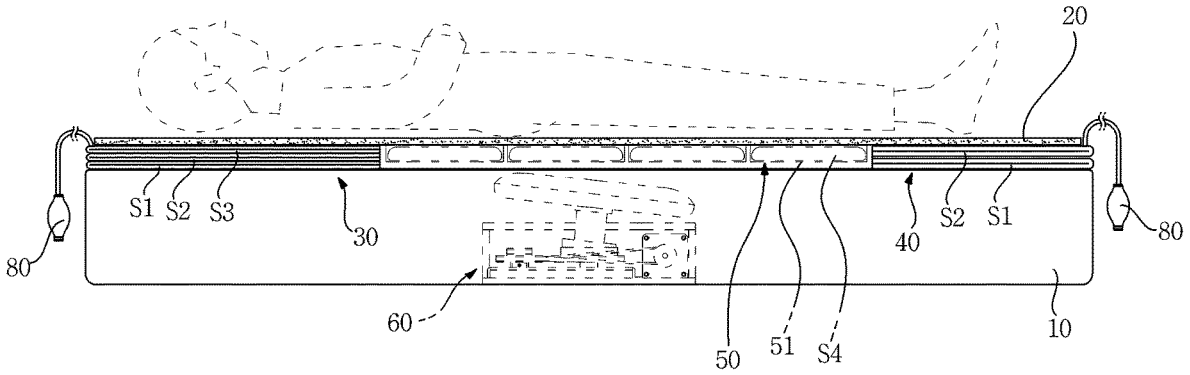
FIG. 17 is a schematic side view of a multifunctional motion bed according to one embodiment of the present invention.

As illustrated in FIG. 17, the user lies on the auxiliary mat 20 so that his/her head is located at the upper end of the auxiliary mat 20 and his/her legs are located at the lower end of the auxiliary mat 20.

The user operates the manual pump 80 or inputs a pumping signal to the controller 90 through the input unit so that a pumping operation of the electric pump 70 is performed.

Then, by the pumping operation of the manual pump 80 or the electric pump 70, air is injected from the air inlet into the air cells S1, S2, and S3 constituting the first air cell module 30 and/or the second air cell module 40 through the connection hose, and thus, the air cells S1, S2, and S3 are inflated.

The one ends of the air cells S1, S2, and S3 are bonded to each other and fixed to the main mat 10 and the auxiliary mat 20, and the other ends of the air cells S1, S2, and S3 are connected to each other by the air support rod 31. Accordingly, when the air cells S1, S2, and S3 are inflated as the air is injected, the air support rod 31 is also inflated, and thus, the air cells S1, S2, and S3 having the stacked structure can be inflated without being shaken or distorted due to the air support rod 31.

Figure 18:
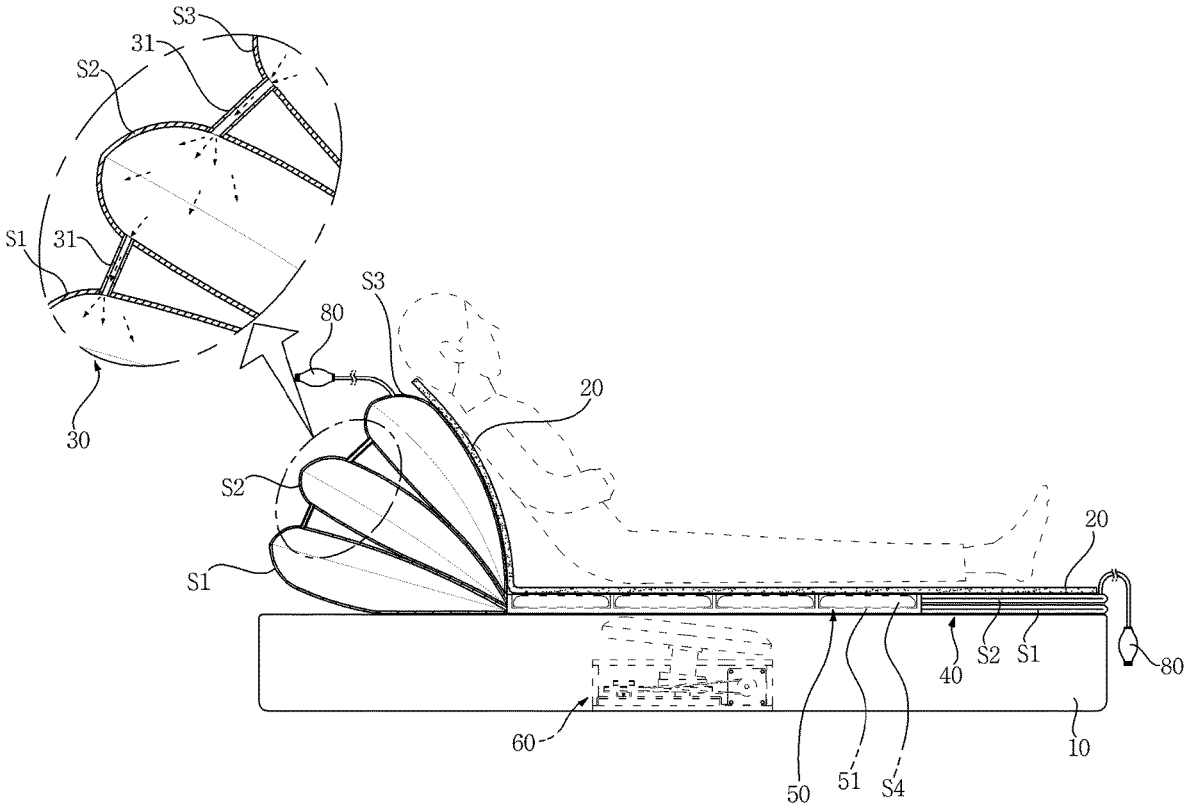
FIG. 18 is a schematic side view of the multifunctional motion bed illustrating a state in which an upper end angle of an auxiliary mat is adjusted through an air cell according to one embodiment of the present invention.
Figure 19:
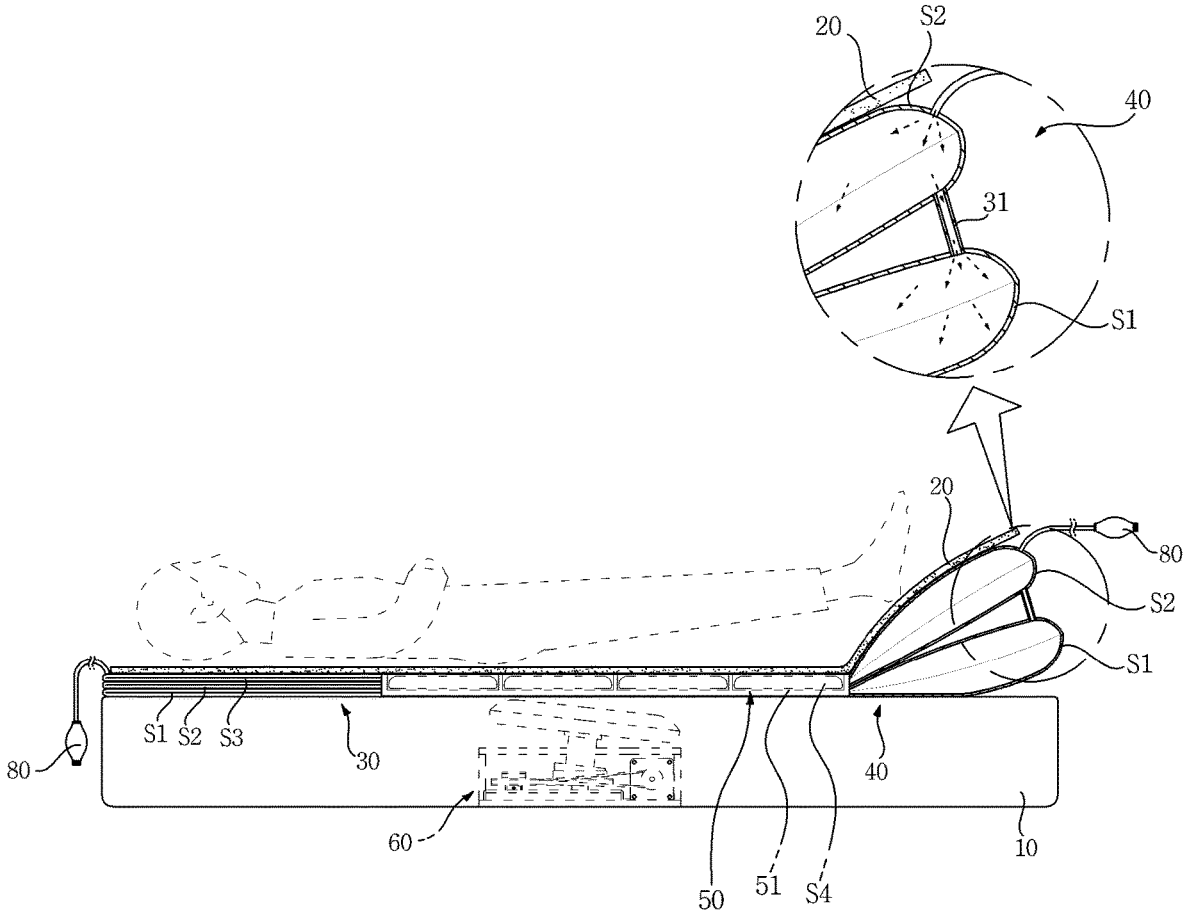
FIG. 19 is a schematic side view of the multifunctional motion bed illustrating a state in which a lower end angle of the auxiliary mat is adjusted through the air cell according to one embodiment of the present invention.

Due to the inflation of the air cells S1, S2, and S3 having the stacked structure, a deployment operation can be realized in which the auxiliary mat 20 positioned at the head and/or the legs is raised. Therefore, as illustrated in FIG. 18, the upper end of the auxiliary mat 20 supports the back of the user. However, as illustrated in FIG. 19, the lower end of the auxiliary mat 20 may raise the legs of the user.

Figure 20:
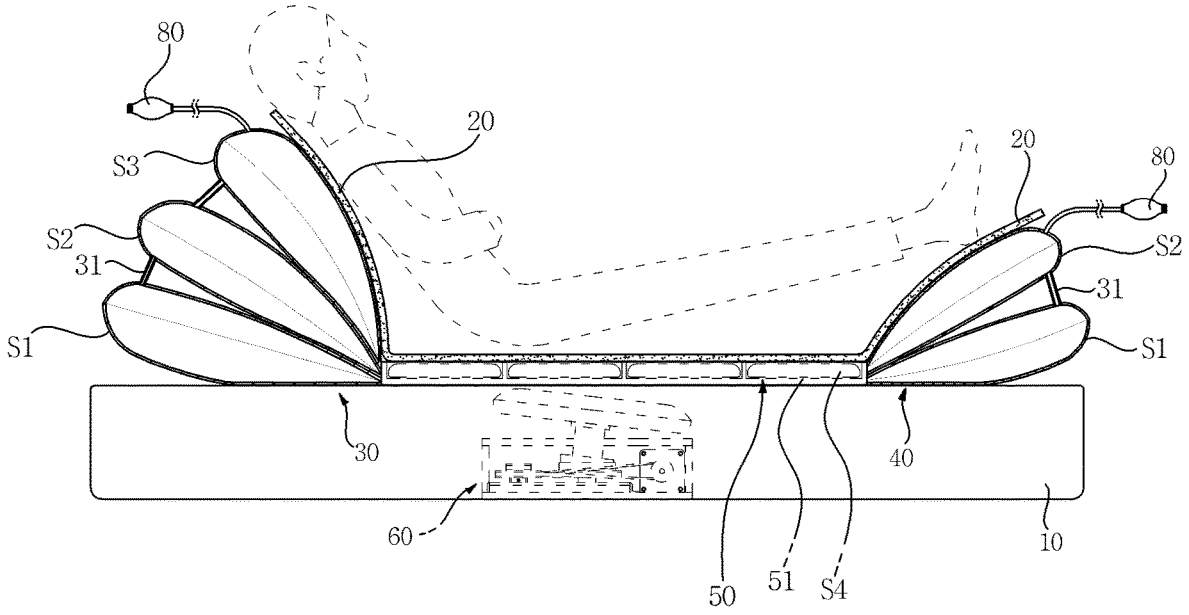
FIG. 20 is a schematic side view of the multifunctional motion bed illustrating a state in which the upper and lower end angles of the auxiliary mat are adjusted through the air cell according to one embodiment of the present invention.
Figure 21:
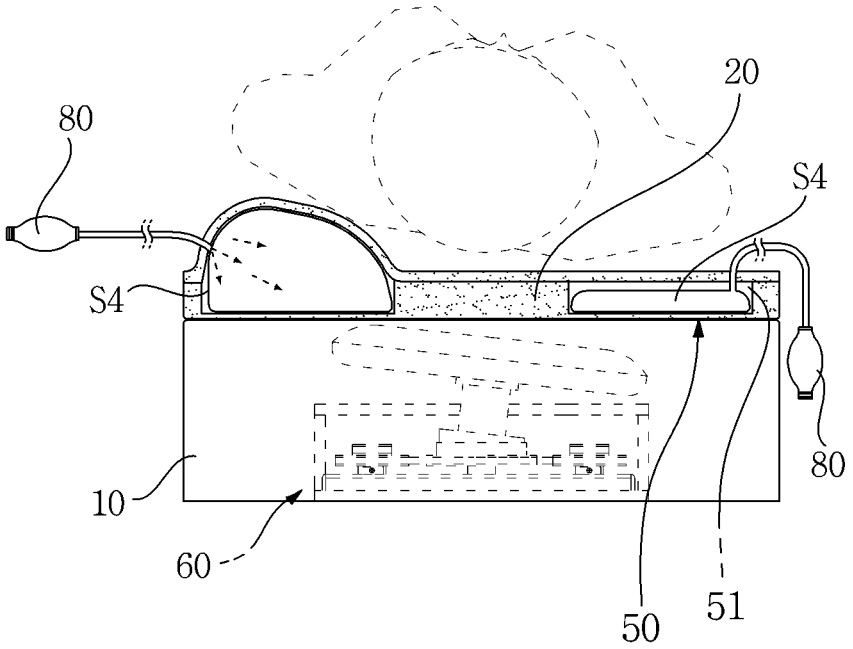
FIGS. 21 and 22 are front views illustrating a state in which each portion of a body is stretched and pulled through the air cell according to one embodiment of the present invention.
Figure 22:
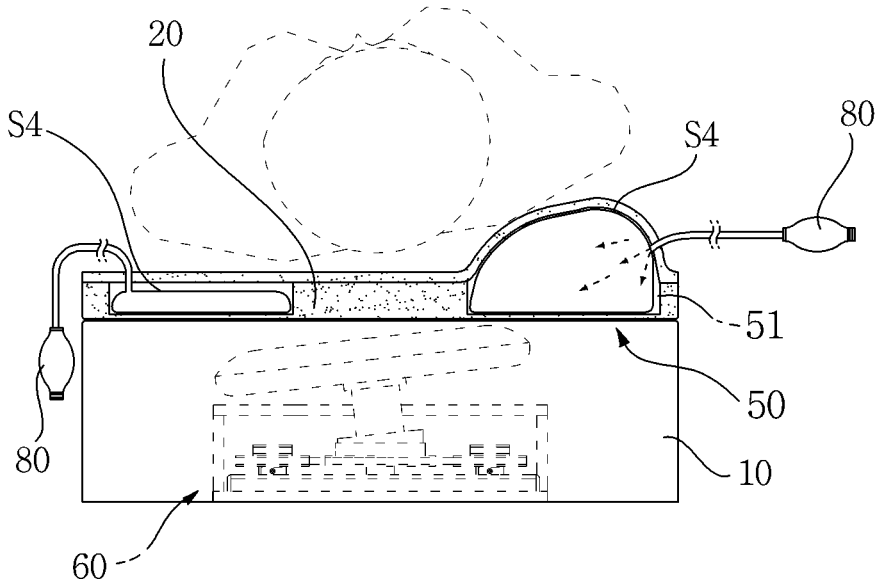

That is, as illustrated in FIGS. 20 to 22, in the multifunctional motion bed according to one embodiment of the present invention, it is possible to easily adjust deployment angles of the head portion and leg portion of the bed through the air cells S1, S2, and S3 even without using a complicated angle adjustment device.

[Air Massage and Stretching Mode]

As illustrated in FIG. 17, the user lies on the auxiliary mat 20 so that his/her head is located at the upper end of the auxiliary mat 20 and his/her legs are located at the lower end of the auxiliary mat 20.

The user operates the manual pump 80 or inputs a pumping signal to the controller 90 through the input unit so that the pumping operation of the electric pump 70 is performed.

Then, by the pumping operation of the manual pump 80 or the electric pump 70, air is injected from the air inlet into the internal space of the air cell S4 of the third air cell module 50 accommodated in the pocket portion 51 which is disposed in the auxiliary mat 20 to correspond to each portion of the body (for example, shoulders, back, waist, pelvis, thighs, knees, calves, or the like), and thus, the air cell S4 is inflated.

When the inflation and deflation are repeated while the inflated air cell S4 is deflated again, each portion of the body of the user lying on the auxiliary mat 20 is raised and lowered repeatedly so that each portion is subjected to air massage and stretching.

That is, in the air massage and stretching mode according to one embodiment of the present invention, all portions or a specific portion of the body of the user lying on the auxiliary mat 20 may be subjected to air massage and stretching by the air cell S4 moving while being inflated or deflated repeatedly.

As an example, as illustrated in FIGS. 21 and 22, when the air cell located on one side (left) of the waist is inflated and the air cell located on the other side (right) of the waist is deflated, pressure is applied to one side of the waist by the inflated air cell in a state in which the other side of the waist is in contact with the auxiliary mat 20 by the deflated air cell, and thus, massage effects on one side of the waist can be expected.

Meanwhile, when the air cells located on both sides of the waist are inflated, pressure is applied to a center of the body by the inflated air cells, and massage effects on both sides of the waist can be expected by the air cells inflated on both sides.

[Three-Dimensional Wave Mode]

When the driver 62 included in the three-dimensional wave generator 60 is turned on in response to the control signal from the controller 90, the drive pulley 62*a* coupled to the drive shaft of the driver 62 rotates in the vertical direction.

That is, the drive pulley 62*a* may be connected to the first-stage pulley portion 63*a* of the first driven pulley 63 through the belt 66, the second-stage pulley portion 63*b* of the first driven pulley 63 may be connected to the first-stage pulley portion 64*a* of the second driven pulley 64 through the belt 66, and the second-stage pulley portion 64*b* of the second driven pulley 64 may be connected to the third driven pulley 65 through the belt 66.

In this case, the multi-stage belt groove 602 divided into multi-stage partition walls 601 are formed in each of the drive pulley 62*a* and the second-stage pulley portions 63*b* and 64*b*, and the groove portion 66*a* and the wing portion

66*b* seated on the partition wall 601 and the belt groove 602 are formed on one surface of the belt 66. Accordingly, when the first to third driven pulleys 63, 64, and 65 rotate in the horizontal direction around the first to third rotating shaft portions 61*b*, 61*b*', and 61*b*" formed in the fixed frame 61*a* according to the driving force transmitted through the drive pulley 62*a* and the belt 66, horizontal rotation is performed stably without movement or separation, and noise caused by power transmission can also be prevented.

In addition, the third driven pulley 65 is disposed at the center of the fixed frame 61*a*, and the first and second driven pulleys 63 and 64 have a triangular arrangement structure with the third driven pulley 65 at one end of the fixed frame 61*a*. Therefore, noise can be also effectively prevented when the driving force of the driver 62 is transmitted while the vertical upright states of the first and second rotating shaft portions 61*b* and 61*b*' are corrected by the correction member 621 formed in the fixed frame 61*a*, that is, the constant vertical upright states are maintained.

Meanwhile, the disk-shaped fixing body 67*a* is formed as the eccentric shaft 67 is formed on the upper surface of the third driven pulley 65, the eccentric disk 67*b* is coupled to the upper surface of the disk-shaped fixing body 67*a*, and the eccentric shaft portion 67*c* is formed on the eccentric disk 67*b*. Accordingly, when the third driven pulley 65 rotates in the horizontal direction, the disk-shaped fixing body 67*a*, the eccentric disk 67*b*, and the eccentric shaft portion 67*c* are rotated eccentrically as illustrated in FIGS. 6 to 11.

In addition, the fixing portion 68 is coupled to the upper surface of the eccentric shaft portion 67*c* and the vibration plate 69 in contact with the auxiliary mat 20 is coupled to the fixing portion 68. Accordingly, when the vibration plate 69 is rotated according to the eccentric rotation of the eccentric shaft 67, the three-dimensional waves are generated by vibrations of the upward-downward movement, and thereafter, the three-dimensional waves are transmitted to the auxiliary mat 20 as illustrated in FIGS. 17 to 22.

That is, the vibration plate 69 includes the central portion 69*a* that is fixed to the fixing portion 68 through the fastening member 100, the disk portion 69*b* that maintains an angle inclined in the first direction from the central portion 69*a*, and the edge portion 69*c* that maintains an angle inclined from the disk portion 69*b* in the second direction opposite to the first direction. Accordingly, when the vibration plate 69 is rotated eccentrically by the eccentric shaft 67, the boundary portion L2 between the disk portion 69*b* and the edge portion 69*c* comes into direct contact with the bottom surface of the auxiliary mat 20, and the three-dimensional waves of the vibrations generated by the upward-downward movement may be transmitted to the auxiliary mat 20.

Meanwhile, the third driven pulley 65 is fit-coupled to the third rotating shaft portion 61*b*" through the bearing B, and the first and second safety rings 501 and 502 included in the safety member 500 are coupled to the upper end of the third rotating shaft portion 61*b*".

That is, the first locking wing 501*a* formed on the inner peripheral surface of the first safety ring 501, and at least one bendable second locking wing 501*b* is formed on the outer peripheral surface of the first safety ring 501. Moreover, the first safety ring 501 is fitted to the upper end of the third rotating shaft portion 61*b*" to which the third driven pulley 65 is coupled, and in this case, the first locking wing 501*a* is fitted and fixed to the first locking groove 402 formed at the upper end of the third rotating shaft portion 61*b*".

In addition, the second safety ring 502 is screw-coupled to the first screw portion 401 formed on the upper end of the third rotating shaft portion 61*b*" through the second screw portion 502*a* formed on the inner peripheral surface, and the second locking wing 501*b* formed on the outer peripheral surface of the first safety ring 501 is locked and fixed to at least one second locking groove 502*b* formed on the outer peripheral surface of the second safety ring 502 by bending.

Accordingly, the first and second safety rings 501 and 502 can maintain a stable fastening state without separation due to rotational loosening at the upper end of the third rotating shaft portion 61*b*", and the third driven pulley 65 can stably rotate at the third rotating shaft portion 61*b*" through the bearing B in the horizontal direction.

In this way, the third driven pulley 65 stably rotates in the horizontal direction and the eccentric shaft 67 coupled to the upper end of the third driven pulley 65 stably rotates eccentrically. Accordingly, the user lying on the auxiliary mat 20 may get a good night's sleep while feeling the vibrations of the three-dimensional waves transmitted to the auxiliary mat 20 and may obtain massage effects of the body and diet effects through a circulatory massage.

Here, the user may set an alarm for waking up through the controller 90. In this case, the three-dimensional waves are transmitted to the main mat 10 or the auxiliary mat 20 formed on the main mat 10 while the driver 62 is driven according to a time set by the timer 91. Accordingly, when the user feels the three-dimensional waves transmitted to the auxiliary mat 20 at the set time, functions of intestines and blood circulation are activated in advance, and thus, the user may wake up refreshingly with his/her mind and body completely awake.

Heretofore, the technical idea of the three-dimensional wave generating device of the present invention and the multifunctional motion bed having the same has been described with the accompanying drawings, but this is illustrative of the best embodiment of the present invention and does not limit the present invention.

Therefore, the present invention is not limited to the specific embodiments described above, and without departing from the gist of the present invention described in the claims, any person with ordinary knowledge in the technical field to which the present invention pertains can implement various modifications, and the modifications fall within the scope of descriptions of the claims.

INDUSTRIAL APPLICABILITY

The present invention applies to a three-dimensional wave generating device interworking with an electronic product that can output a sound, in which operation stability is secured while noise caused by separation or unstable coupling of a driven pulley and/or an eccentric shaft are prevented, and when the three-dimensional wave generating device is applied to a functional motion bed, the user can more effectively feel three-dimensional waves in the bed.

The invention claimed is:

1. A multifunctional motion bed comprising:

a main mat supported by a frame and located at a lower portion;

a bendable auxiliary mat placed on the main mat and located at an upper portion;

a first air cell module connected to upper end portions of the main mat and auxiliary mat and inflated or deflated depending on whether air is supplied to adjust a deployment angle of the upper end portion of the bendable auxiliary mat; and a three-dimensional wave generator formed inside the main mat and configured to generate three-dimensional waves and transmit the generated three-dimensional waves to the auxiliary mat, wherein the three-dimensional wave generator includes:

a housing to which a noise-preventing fixed frame, from which first, second, and third rotating shaft portions protrude, is coupled;

a driver coupled to one end of the fixed frame and having a drive pulley;

a third driven pulley rotatably coupled to the third rotating shaft portion, which protrudes from a center of the fixed frame, through a bearing;

first and second driven pulleys rotatably coupled to the first and second rotating shaft portions, which protrude from the other end of the fixed frame, through a bearing to have a triangular arrangement structure with the third driven pulley;

a power transmission belt connecting the drive pulley to each of the first to third driven pulleys;

an eccentric shaft coupled to an upper surface of the third driven pulley and eccentrically rotated according to a rotation of the third driven pulley;

a fixing portion formed on an upper surface of the eccentric shaft; and a vibration plate in close contact with a bottom surface of the auxiliary mat while being coupled to the fixing portion and configured to generate a three-dimensional wave through vibration of an upward-downward movement according to an eccentric rotation of the eccentric shaft and transmit the generated three-dimensional wave to the auxiliary mat, a first screw portion and a first locking groove are formed at an upper end of the first rotating shaft portion, and a safety member locked to the first locking groove to prevent rotation is fastened to the first screw portion so that the third driven pulley fit-coupled through a bearing is prevented from being separated from the third rotating shaft portion, wherein the safety member includes:

a first safety ring fitted to an upper end of the third rotating shaft portion and having a first locking wing formed on an inner peripheral surface and at least one bendable second locking wing formed on an outer peripheral surface; and a second safety ring disposed above the first safety ring at the upper end of the third rotating shaft portion and having a second screw portion formed on an inner peripheral surface to be fastened to the first screw portion and at least one second locking groove formed on an outer peripheral surface, the first locking wing is locked and fixed to the first locking groove to prevent rotational loosening of the first and second screw portions, and the second locking wing is locked and fixed to the second locking groove while being bent to prevent the rotational loosening of the first and second screw portions.

2. The multifunctional motion bed of claim 1, wherein lower end portions of the main mat and the auxiliary mat are connected by a second air cell module configured to adjust a deployment angle of the lower end portion of the auxiliary mat.

3. The multifunctional motion bed of claim 2, wherein the first air cell module and the second air cell module have the same structure and are formed by stacking one or more air cells, one ends of the stacked air cells are bonded and then fixed to the main mat and auxiliary mat, and the other ends of the air cells are separated to be inflated when air is supplied to an inside of each of the air cells, and the other ends of the air cells are connected by an air support rod which is deflated by the air supplied into the air cells to support the air cells.

4. The multifunctional motion bed of claim 2, wherein a third air cell module, which is inflated or deflated depending on whether air is supplied for air massage and stretching with respect to each portion of a body, is provided inside the auxiliary mat.

5. The multifunctional motion bed of claim 4, wherein in the third air cell module, a pocket portion is disposed inside the auxiliary mat to correspond to each portion of the body, and an inflatable or deflatable air cell is provided in the pocket portion.

6. The multifunctional motion bed of claim 4, wherein the first to third air cell modules are connected to an electric pump or a manual pump through a connection hose, and when the first to third air cell modules are connected to the electric pump through the connection hose, a controller controls the electric pump to be turned on or off.

7. The multifunctional motion bed of claim 6, wherein for driving of the driver, the driver is controlled to be turned on or off by the controller, and a control program that sequentially controls the electric pump and the driver to be turned on or off is installed in the controller, and the control program is executed according to an operation condition of a user made through an input unit or a set time made by a timer.

8. The multifunctional motion bed of claim 7, wherein the three-dimensional wave generator interworks with a sound generator, and the sound generator operates and outputs a sound according to a control signal of the controller prior to operation of the three-dimensional wave generator.

9. The multifunctional motion bed of claim 8, wherein the sound generator includes a TV or an audio which is an electronic product allowing at least a sound to be output.

10. The multifunctional motion bed of claim 1, wherein a correction member configured to correct vertical upright states of the first and second rotating shaft portions is formed on the fixed frame.

11. The multifunctional motion bed of claim 10, wherein the correction member includes:

a fixing block fixed to the fixed frame by a screw; and a correction screw supporting the first and second rotating shaft portions while passing through the fixing block.

12. The multifunctional motion bed of claim 1, wherein the first driven pulley includes a first-stage pulley portion connected to the drive pulley through a belt and a second-stage pulley portion connected to the second driven pulley through a belt, the second driven pulley includes a first-stage pulley portion connected to the second-stage pulley portion of the first driven pulley through a belt and a second-stage pulley portion connected to the third driven pulley through a belt, and a diameter of the first-stage pulley portion is larger than a diameter of the second-stage pulley portion.

13. The multifunctional motion bed of claim 12, wherein a multi-stage belt groove divided into multi-stage partition walls is formed in each of the drive pulley and the second-stage pulley portion, and a groove portion and a wing portion seated at the partition wall and the belt groove are formed at one surface of the belt to prevent movement caused by rotation.

14. The multifunctional motion bed of claim 1, wherein the eccentric shaft includes:

a disk-shaped fixing body formed at a center of the upper surface of the third driven pulley and having an equal height;

an eccentric disk coupled to an upper surface of the fixing body by a fastening member and including one end and the other end having heights different from each other; and an eccentric shaft portion which is formed at a center of an upper surface of the eccentric disk and to which the fixing portion is coupled through a fastening member.

15. The multifunctional motion bed of claim 1, wherein the vibration plate includes a central portion fixed to the fixing portion through a fastening member, a disk portion at an angle inclined in a first direction from the central portion, and an edge portion at an angle inclined in a second direction opposite to the first direction from the disk portion.

16. A three-dimensional wave generating device accommodated in a mat, comprising:

a housing to which a noise-preventing fixed frame, from which first, second, and third rotating shaft portions protrude, is coupled;

a driver coupled to one end of the fixed frame and having a drive pulley;

a third driven pulley rotatably coupled to the third rotating shaft portion, which protrudes from a center of the fixed frame, through a bearing;

first and second driven pulleys rotatably coupled to the first and second rotating shaft portions, which protrude from the other end of the fixed frame, through a bearing, to have a triangular arrangement structure with the third driven pulley;

a power transmission belt connecting the drive pulley to each of the first to third driven pulleys;

an eccentric shaft coupled to an upper surface of the third driven pulley and eccentrically rotated according to a rotation of the third driven pulley;

a fixing portion formed on an upper surface of the eccentric shaft; and a vibration plate in close contact with a bottom surface of the mat while being coupled to the fixing portion and configured to generate a three-dimensional wave through vibration of an upward-downward movement according to an eccentric rotation of the eccentric shaft and transmit the generated three-dimensional wave to the mat, a first screw portion and a first locking groove are formed at an upper end of the third rotating shaft portion, and a safety member locked to the first locking groove to prevent rotation is fastened to the first screw portion so that the third driven pulley fit-coupled through a bearing is prevented from being separated from the third rotating shaft portion, wherein the safety member includes:

a first safety ring fitted to an upper end of the third rotating shaft portion and having a first locking wing formed on an inner peripheral surface and at least one bendable second locking wing formed on an outer peripheral surface; and a second safety ring disposed above the first safety ring at the upper end of the third rotating shaft portion and having a second screw portion formed on an inner peripheral surface to be fastened to the first screw portion and at least one second locking groove formed on an outer peripheral surface, the first locking wing is locked and fixed to the first locking groove to prevent rotational loosening of the first and second screw portions, and the second locking wing is locked and fixed to the second locking groove while being bent to prevent the rotational loosening of the first and second screw portions.

17. The three-dimensional wave generating device of claim 16, wherein the mat includes a main mat or a main mat and an auxiliary mat that are formed as a stacked structure, and the vibration plate is in contact with an inner upper surface of the main mat.

18. The three-dimensional wave generating device of claim 17, wherein a correction member configured to correct vertical upright states of the first and second rotating shaft portions is formed on the fixed frame.

19. The three-dimensional wave generating device of claim 18, wherein correction member includes:

a fixing block fixed to the fixed frame by a screw; and a correction screw supporting the first and second rotating shaft portions while passing through the fixing block.

20. The three-dimensional wave generating device of claim 16, wherein the first driven pulley includes a first-stage pulley portion connected to the drive pulley through a belt and a second-stage pulley portion connected to the second driven pulley through a belt, the second driven pulley includes a first-stage pulley portion connected to the second-stage pulley portion of the first driven pulley through a belt and a second-stage pulley portion connected to the third driven pulley through a belt, and a diameter of the first-stage pulley portion is larger than a diameter of the second-stage pulley portion.

21. The three-dimensional wave generating device of claim 20, wherein a multi-stage belt groove divided into multi-stage partition walls is formed in each of the drive pulley and the second-stage pulley portion, and a groove portion and a wing portion seated at the partition wall and the belt groove are formed at one surface of the belt to prevent movement caused by rotation.

22. The three-dimensional wave generating device of claim 16, wherein the eccentric shaft includes:

a disk-shaped fixing body formed at a center of an upper surface of the third driven pulley and having an equal height;

an eccentric disk coupled to an upper surface of the fixing body by a fastening member and including one end and the other end having heights different from each other; and an eccentric shaft portion which is formed at a center of an upper surface of the eccentric disk and to which the fixing portion is coupled through a fastening member.

23. The three-dimensional wave generating device of claim 16, wherein the vibration plate includes a central portion fixed to the fixing portion through a fastening member, a disk portion at an angle inclined in a first direction from the central portion, and an edge portion at an angle inclined in a second direction opposite to the first direction from the disk portion.

24. The three-dimensional wave generating device of claim 16, wherein for driving of the driver, the driver is controlled to be turned on or off by a controller, a control program that controls the driver to be sequentially turned on and off is installed in the controller, and the control program is executed according to an operation condition of a user made through an input unit or a set time made by a timer.

* * * * *